US011725405B2

(12) United States Patent
Morimura et al.

(10) Patent No.: US 11,725,405 B2
(45) Date of Patent: Aug. 15, 2023

(54) BINDING MACHINE

(71) Applicant: MAX CO., LTD., Tokyo (JP)

(72) Inventors: Kouichirou Morimura, Tokyo (JP); Yusuke Yoshida, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 17/387,110

(22) Filed: Jul. 28, 2021

(65) Prior Publication Data

US 2022/0034109 A1 Feb. 3, 2022

(30) Foreign Application Priority Data

Jul. 31, 2020 (JP) ..... 2020-131158

(51) Int. Cl.
*B21F 15/02* (2006.01)
*E04G 21/12* (2006.01)

(52) U.S. Cl.
CPC ..... *E04G 21/123* (2013.01)

(58) Field of Classification Search
CPC ..... B21F 15/02; B21F 15/04; E04G 21/122; E04G 21/123; B65B 13/025; B65B 13/04; B65B 13/08; B65B 13/14
See application file for complete search history.

(56) References Cited

U.S. PATENT DOCUMENTS 5,613,432 A 3/1997 Hoshino
5,983,473 A 11/1999 Yuguchi et al.
2006/0011254 A1 1/2006 Yokochi et al.
2018/0161848 A1 6/2018 Itagaki et al.
2018/0187431 A1 7/2018 Itagaki et al.
2018/0187434 A1 7/2018 Itagaki et al.
2021/0180347 A1* 6/2021 Mizuno ..... B21F 15/06

FOREIGN PATENT DOCUMENTS

| | | | |
|---|---|---|---|
| CN | 1128721 | A | 8/1996 |
| CN | 1184521 | A | 6/1998 |
| CN | 108313358 | A | 7/2018 |
| CN | 208036703 | U | 11/2018 |
| EP | 3327220 | A1 | 5/2018 |
| EP | 3342953 | A1 | 7/2018 |
| EP | 3342956 | A1 | 7/2018 |
| JP | 2004-142813 | A | 5/2004 |

OTHER PUBLICATIONS

Extended European Search Report for EP Application No. 21188684.1 dated Dec. 9, 2021. (16 pp.).

* cited by examiner

*Primary Examiner* — Debra M Sullivan
(74) *Attorney, Agent, or Firm* — Weihrouch IP

(57) ABSTRACT

A binding machine includes: a wire feeding unit configured to feed a wire; a curl guide configured to curl the wire fed in a forward direction by the wire feeding unit; and a binding unit configured to twist the wire fed in a reverse direction by the wire feeding unit and wound on an object. The binding unit includes a wire engaging body configured to engage a tip end-side of the wire fed in the forward direction by the wire feeding unit, curled by the curl guide and wound around the object. The binding machine includes a pulling unit for pulling, toward the object, a wire on a second side positioned on an opposite side to the curl guide with respect to the object earlier than a wire on a first side positioned on the curl guide of the wire wound around the object and engaged at its tip end.

10 Claims, 20 Drawing Sheets

BINDING MACHINE

CROSS-REFERENCE TO RELATED APPLICATIONS

This application claims priority to Japanese Patent Application No. 2020-131158 filed on Jul. 31, 2020, the content of which is incorporated herein by reference.

TECHNICAL FIELD

The present disclosure relates to a binding machine configured to bind an object such as a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine configured to wind two or more reinforcing bars with a wire, and to twist the wire wound on the reinforcing bars, thereby binding the two or more reinforcing bars with the wire. The binding machine includes a binding wire feeding mechanism configured to deliver the wire wound on a reel and to wind the binding wire on the reinforcing bars, a gripping mechanism configured to grip the wire wound on the reinforcing bars, and a binding wire twisting mechanism configured to twist the wire by rotationally driving the gripping mechanism, and the wire feeding mechanism, the gripping mechanism and the wire twisting mechanism sequentially operate by a trigger operation, so that a binding operation of one cycle is performed.

When binding the reinforcing bars with the wire, if the binding is loosened, the reinforcing bars deviate each other, so that it is required to firmly maintain the reinforcing bars. Therefore, suggested is a technology of feeding the wire wound around the reinforcing bars in a reverse direction and winding the wire on the reinforcing bars (for example, refer to JP 2004-142813 A).

In the binding machine of the related art, in a state where the wire is wound around the reinforcing bars along a nose and a lower guide arm, the wire is engaged by a clamp device and is then fed in the reverse direction.

In this case, the wire wound around the reinforcing bars is first moved at a wire of a portion along the nose toward the reinforcing bars. When the wire of the portion along the nose is moved to a position in which it is in contact with the reinforcing bars, the friction between the wire and the reinforcing bars increases the load of feeding the wire in the reverse direction. For this reason, a wire of a portion along the lower guide arm cannot be sufficiently pulled back, so that the wire may not be wound on the reinforcing bars.

SUMMARY OF INVENTION

The present invention has been made to address the above issue, and an object thereof is to provide a binding machine capable of winding a wire around an object.

According to an embodiment of the present invention, there is provided a binding machine that includes: a wire feeding unit configured to feed a wire; a curl guide configured to curl the wire that is fed in a forward direction by the wire feeding unit; and a binding unit configured to twist the wire fed in a reverse direction by the wire feeding unit and wound on an object. The binding unit includes a wire engaging body configured to engage a tip end-side of the wire fed in the forward direction by the wire feeding unit, curled by the curl guide and wound around the object. The binding machine includes a pulling unit for pulling, toward the object, a wire on a second side positioned on an opposite side to the curl guide with respect to the object earlier than a wire on a first side positioned on the curl guide of the wire wound around the object and engaged at its tip end.

According to the embodiment of the present invention, the wire on the second side, which is positioned on an opposite side to the curl guide with respect to the object, of the wire wound around the object and engaged at the tip end is first pulled toward the object and the wire on the first side positioned on the curl guide is then pulled toward the object.

The wire on the first side, which is positioned on the curl guide, of the wire wound around the object and engaged at the tip end is less susceptible to the friction resulting from the butting of the wire against the object during the operation of feeding the wire in the reverse direction. Therefore, the wire can be securely wound on the object by pulling the wire on the second side, which is positioned on an opposite side to the curl guide with respect to the object, toward the object and then pulling the wire on the first side positioned on the curl guide toward the object.

DESCRIPTION OF EMBODIMENTS

Hereinafter, an example of a reinforcing bar binding machine that is an embodiment of the binding machine of the present invention will be described with reference to the drawings.

<Configuration Example of Reinforcing Bar Binding Machine>

Figure 1:
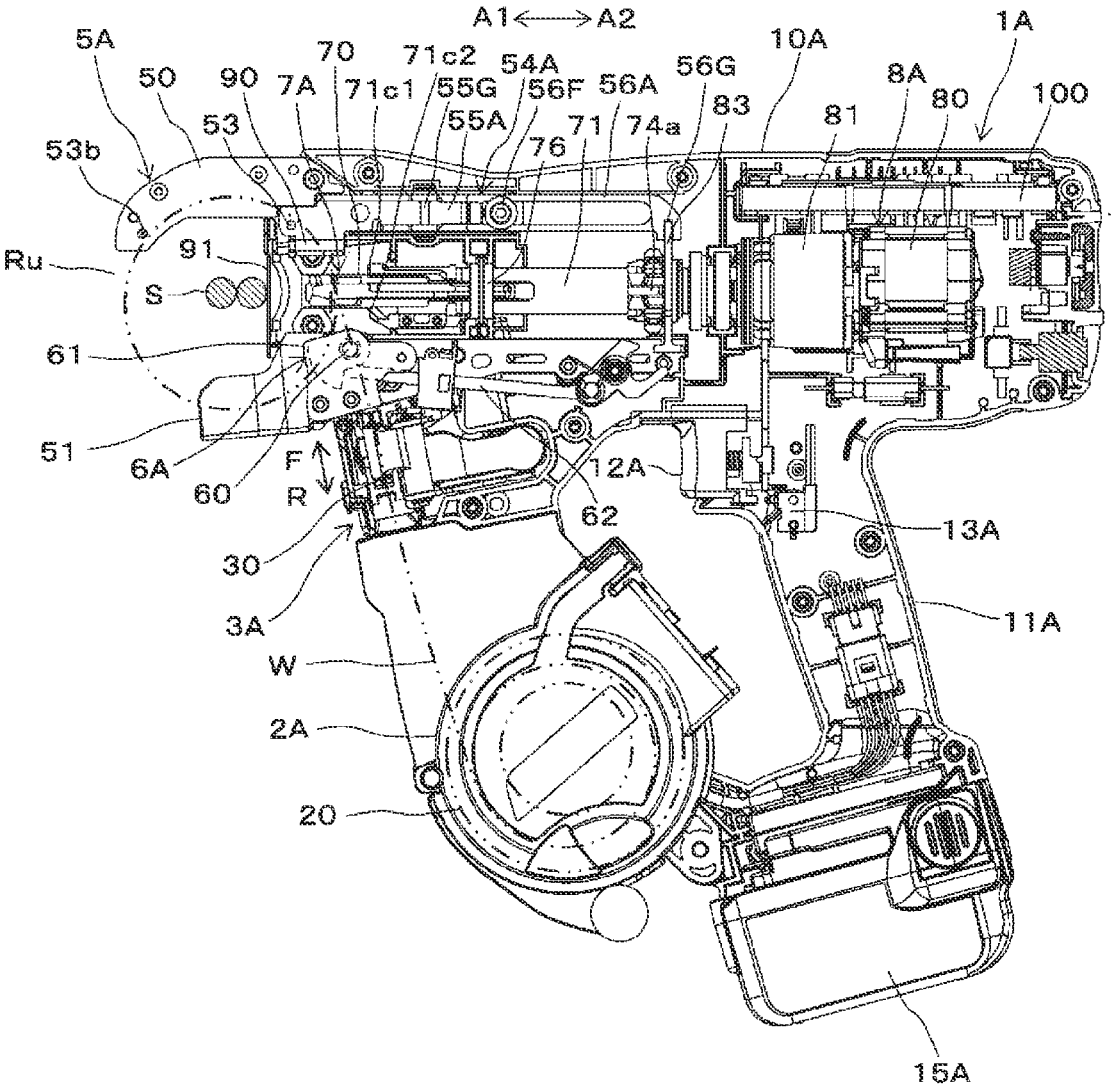
FIG. 1 is a view showing an example of an entire configuration of a reinforcing bar binding machine, as seen from a side.

FIG. 1 is a view showing an example of an entire configuration of a reinforcing bar binding machine, as seen from a side. A reinforcing bar binding machine 1A has such a shape that an operator grips with a hand, and includes a main body part 10A and a handle part 11A.

The reinforcing bar binding machine 1A is configured to feed a wire W in a forward direction denoted with an arrow F, to wind the wire around reinforcing bars S, which are a to-be-bound object, to feed the wire W wound around the reinforcing bars S in a reverse direction denoted with an arrow R, to wind the wire on the reinforcing bars S, and to twist the wire W, thereby binding the reinforcing bars S with the wire W.

In order to implement the above functions, the reinforcing bar binding machine 1A includes a magazine 2A in which the wire W is accommodated, and a wire feeding unit 3A configured to feed the wire W. The reinforcing bar binding machine 1A also includes a curl forming unit 5A configured to form a path along which the wire W fed by the wire feeding unit 3A is to be wound around the reinforcing bars S, and a cutting unit 6A configured to cut the wire W wound on the reinforcing bars S. The reinforcing bar binding machine 1A also includes a binding unit 7A configured to twist the wire W wound on the reinforcing bars S, and a drive unit 8A configured to drive the binding unit 7A.

In the magazine 2A, a reel 20 on which the long wire W is wound to be reeled out is rotatably and detachably accommodated. For the wire W, a wire made of a plastically deformable metal wire, a wire having a metal wire covered with a resin, a twisted wire or the like are used. The reel 20 is configured so that one or more wires W are wound on a hub part (not shown) and can be reeled out from the reel 20 at the same time.

The wire feeding unit 3A includes a pair of feeding gears 30 configured to sandwich and feed one or more wires W aligned in parallel. In the wire feeding unit 3A, a rotating operation of a feeding motor (not shown) is transmitted to rotate the feeding gears 30. Thereby, the wire feeding unit 3A feeds the wire W sandwiched between the pair of feeding gears 30 along an extension direction of the wire W. In a configuration where a plurality of, for example, two wires W are fed, the two wires W are fed aligned in parallel.

The wire feeding unit 3A is configured so that the rotation directions of the feeding gears 30 are switched and the feeding direction of the wire W is switched between forward and reverse directions by switching the rotation direction of the feeding motor (not shown) between forward and reverse directions.

The curl forming unit 5A includes a curl guide 50, which is an example of the first guide part configured to curl the wire W that is fed by the wire feeding unit 30, and an induction guide 51, which is an example of the second guide part configured to guide the wire W curled by the curl guide 50 toward the binding unit 7A. In the reinforcing bar binding machine 1A, a path of the wire W that is fed by the wire feeding unit 3A is regulated by the curl forming unit 5A, so that a locus of the wire W becomes a loop Ru as shown with a broken line in FIG. 1 and the wire W is thus wound around the reinforcing bars S.

The curl forming unit 5A has guide members 53 and 53*b* configured to guide the wire W that is fed in the forward direction, and to curl the wire W. The guide member 53 constitutes a pulling unit for pulling the wire W from a predetermined side in cooperation with the wire feeding unit 3A. The guide member 53 is provided on a side of the curl guide 50 on which the wire W fed by the wire feeding unit 3A is introduced, and is arranged on a radially inner side of the loop Ru that is formed by the wire W. The guide member 53 is configured to regulate the wire W so that the wire W does not enter a radially inner side of the loop Ru.

The guide member 53*b* is provided on a side of the curl guide 50 on which the wire W fed by the wire feeding unit 3A is discharged, and is arranged on a radially outer side of the loop Ru that is formed by the wire W.

The curl forming unit 5A includes a guide member moving mechanism 54A configured to retreat the guide member 53. The guide member moving mechanism 54A constitutes a pulling unit for pulling the wire W from a predetermined side in cooperation with the wire feeding unit 3A, and is configured to retreat the guide member 53 in conjunction with an operation of the binding unit 7A after the wire W is wound on the reinforcing bars S.

The cutting unit 6A includes a fixed blade part 60, a movable blade part 61 configured to cut the wire W in cooperation with the fixed blade part 60, and a transmission mechanism 62 configured to transmit an operation of the binding unit 7A to the movable blade part 61. The cutting unit 6A is configured to cut the wire W by a rotating operation of the movable blade part 61 about the fixed blade part 60, which is a support point. The transmission mechanism 62 is configured to transmit an operation of the binding unit 7A to the movable blade part 61 via a movable member 83 and to rotate the movable blade part 61 in conjunction with an operation of the binding unit 7A, thereby cutting the wire W.

The binding unit 7A includes a wire engaging body 70 to which the wire W is engaged. A detailed embodiment of the binding unit 7A will be described later. The drive unit 8A includes a motor 80, and a decelerator 81 configured to perform deceleration and amplification of torque.

The reinforcing bar binding machine 1A includes a feeding regulation part 90 against which a tip end of the wire W is butted, on a feeding path of the wire W that is engaged by the wire engaging body 70. In the reinforcing bar binding machine 1A, the curl guide 50 and the induction guide 51 of the curl forming unit 5A are provided at an end portion on a front side of the main body part 10A. In the reinforcing bar binding machine 1A, a butting part 91 against which the reinforcing bars S are to be butted is provided at the end portion on the front side of the main body part 10A and between the curl guide 50 and the induction guide 51.

In the reinforcing bar binding machine 1A, the handle part 11A extends downwardly from the main body part 10A. Also, a battery 15A is detachably mounted to a lower part of the handle part 11A. Also, the magazine 2A of the reinforcing bar binding machine 1A is provided in front of the handle part 11A. In the main body part 10A of the reinforcing bar binding machine 1A, the wire feeding unit 3A, the cutting unit 6A, the binding unit 7A, the drive unit 8A configured to drive the binding unit 7A, and the like are accommodated.

A trigger 12A is provided on a front side of the handle part 11A of the reinforcing bar binding machine 1A, and a switch 13A is provided inside the handle part 11A. In addition, the main body part 10A is provided with a substrate 100 on which a circuit constituting a control unit is mounted.

Figure 2A:
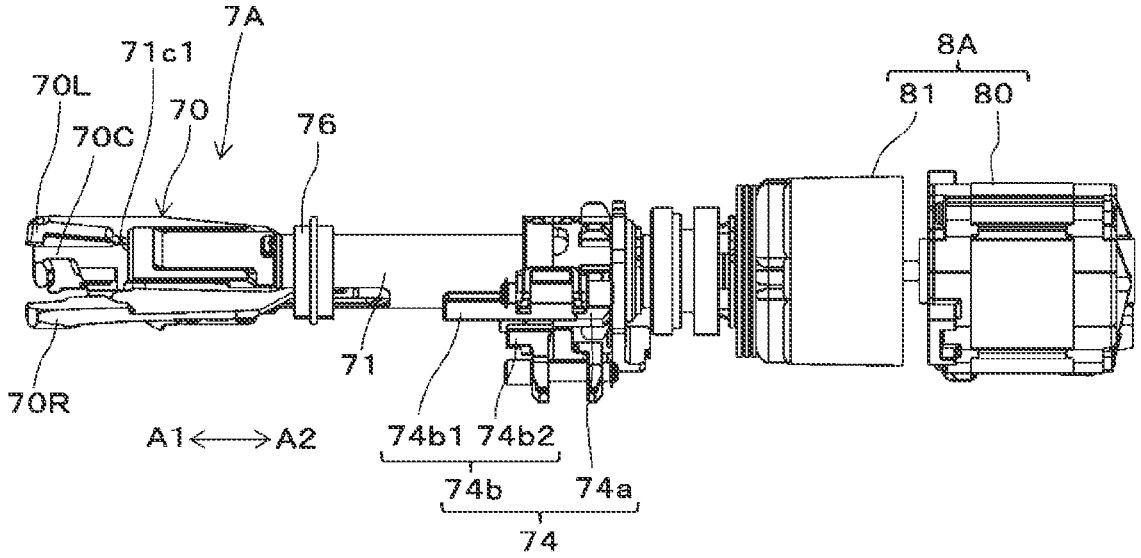
FIG. 2A is a perspective view showing an example of a binding unit.
Figure 2B:
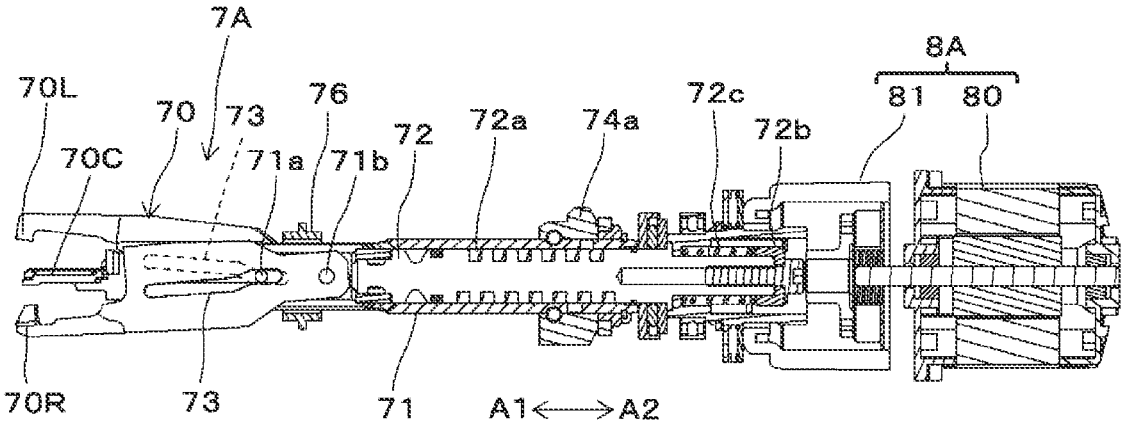
FIG. 2B is a sectional plan view showing the example of the binding unit.
Figure 2C:
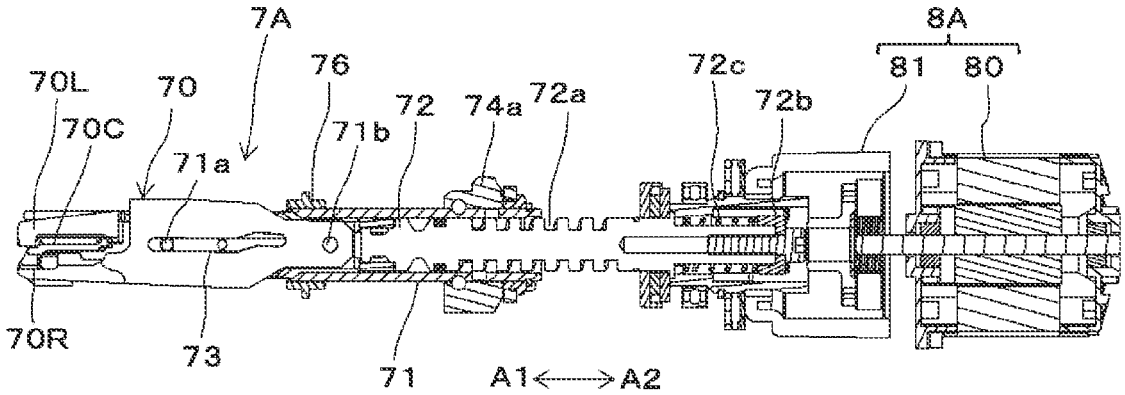
FIG. 2C is a sectional plan view showing the example of the binding unit.

FIG. 2A is a perspective view showing an example of the binding unit, and FIGS. 2B and 2C are sectional plan views showing the example of the binding unit. In the below, a configuration of the binding unit is described with reference to each drawing.

The binding unit 7A includes a wire engaging body 70 to which the wire W is to be engaged, and a rotary shaft 72 for actuating the wire engaging body 70. The binding unit 7A and the drive unit 8A are configured so that the rotary shaft 72 and the motor 80 are connected each other via the decelerator 81 and the rotary shaft 72 is driven via the decelerator 81 by the motor 80.

The wire engaging body 70 has a center hook 70C connected to the rotary shaft 72, a first side hook 70R and a second side hook 70L configured to open and close with respect to the center hook 70C, and a sleeve 71 configured to actuate the first side hook 70R and the second side hook 70L and to form the wire W into a desired shape.

In the binding unit 7A, a side on which the center hook 70C, the first side hook 70R and the second side hook 70L are provided is referred to as a front side, and a side on which the rotary shaft 72 is connected to the decelerator 81 is referred to as a rear side.

The center hook 70C is connected to a front end of the rotary shaft 72, which is one end portion, via a configuration that can rotate with respect to the rotary shaft 72 and move integrally with the rotary shaft 72 in an axis direction.

A tip end-side of the first side hook 70R, which is one end portion in the axis direction of the rotary shaft 72, is positioned at one side part with respect to the center hook 70C. A rear end-side of the first side hook 70R, which is the other end portion in the axis direction of the rotary shaft 72, is rotatably supported to the center hook 70C by a shaft 71*b*.

A tip end-side of the second side hook 70L, which is one end portion in the axis direction of the rotary shaft 72, is positioned at the other side part with respect to the center hook 70C. A rear end-side of the second side hook 70L, which is the other end portion in the axis direction of the rotary shaft 72, is rotatably supported to the center hook 70C by the shaft 71*b*.

Thereby, the wire engaging body 70 opens/closes in directions in which the tip end-side of the first side hook 70R separates and contacts with respect to the center hook 70C by a rotating operation about the shaft 71*b* as a support point. The wire engaging body 70 also opens/closes in directions in which the tip end-side of the second side hook 70*l* separates and contacts with respect to the center hook 70C.

A rear end of the rotary shaft 72, which is the other end portion, is connected to the decelerator 81 via a connection portion 72*b* having a configuration that can cause the connection portion to rotate integrally with the decelerator 81 and to move in the axis direction with respect to the decelerator 81. The connection portion 72*b* has a spring 72*c* for urging backward the rotary shaft 72 toward the decelerator 81. In this way, the rotary shaft 72 is configured to be movable forward away from the decelerator 81 while receiving a force pulled backward by the spring 72*c*.

The sleeve 71 is supported to be rotatable and to be axially slidable by a support frame 76. The support frame 76 is an annular member and is attached to the main body part 10A in a form in which it cannot rotate circumferentially and move axially.

The sleeve 71 has a convex portion (not shown) protruding from an inner peripheral surface of a space in which the rotary shaft 72 is inserted, and the convex portion enters a groove portion of a feeding screw 72*a* formed along the axis direction on an outer periphery of the rotary shaft 72. When the rotary shaft 72 rotates, the sleeve 71 moves in a front and rear direction along the axis direction of the rotary shaft 72 according to a rotation direction of the rotary shaft 72 by an action of the convex portion (not shown) and the feeding screw 72*a* of the rotary shaft 72. The sleeve 71 also rotates integrally with the rotary shaft 72.

The sleeve 71 has an opening/closing pin 71*a* configured to open/close the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending in a moving direction of the sleeve 71 and converting linear motion of the opening/closing pin 71*a* configured to move in conjunction with the sleeve 71 into an opening/closing operation by rotation of the first side hook 70R and the second side hook 70L about the shaft 71*b* as a support point.

The wire engaging body 70 is configured so that, when the sleeve 71 is moved backward (refer to an arrow A2), the first side hook 70R and the second side hook 70L move away from the center hook 70C by the rotating operations about the shaft 71*b* as a support point, due to a locus of the opening/closing pin 71*a* and the shape of the opening/closing guide holes 73.

Thereby, the first side hook 70R and the second side hook 70L are opened with respect to the center hook 70C, so that a feeding path through which the wire W is to pass is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3A passes between the center hook 70C and the first side hook 70R. The wire W passing between the center hook 70C and the first side hook 70R is guided to the curl forming unit 5A. Then, the wire curled by the curl forming unit 5A and guided to the binding unit 7A passes between the center hook 70C and the second side hook 70L.

The wire engaging body 70 is configured so that, when the sleeve 71 is moved in the forward direction denoted with an arrow A1, the first side hook 70R and the second side hook 70L move toward the center hook 70C by the rotating operations about the shaft 76 as a support point, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is engaged in such an aspect that the wire can move between the first side hook 70R and the center hook 70C. Also, when the second side hook 70L is closed with respect to the center hook 70C, the wire W sandwiched between the second side hook 70L and the center hook 70C is engaged in such an aspect that the wire cannot come off from between the second side hook 70L and the center hook 70C.

The sleeve 71 has a bending portion 71*c*1 configured to push and bend a tip end-side (one end portion) of the wire W in a predetermined direction to form the wire W into a predetermined shape, and a bending portion 71*c*2 configured to push and bend a terminal end-side (the other end portion) of the wire W cut by the cutting unit 6A in a predetermined direction to form the wire W into a predetermined shape.

The sleeve 71 is moved in the forward direction denoted with the arrow A1, so that the tip end-side of the wire W engaged by the center hook 70C and the second side hook 70L is pushed and is bent toward the reinforcing bars S by the bending portion 71*c*1. Also, the sleeve 71 is moved in the forward direction denoted with the arrow A1, so that the terminal end-side of the wire W engaged by the center hook 70C and the first side hook 70R and cut by the cutting unit 6A is pushed and bent toward the reinforcing bars S by the bending portion 71*c*2.

The binding unit 7A includes a rotation regulation part 74 configured to regulate rotations of the wire engaging body 70 and the sleeve 71 in conjunction with the rotating operation of the rotary shaft 72. The rotation regulation part 74 has a rotation regulation blade 74*a* provided to the sleeve 71 and a rotation regulation claw 74*b* provided to the main body part 10A.

The rotation regulation blade 74*a* is constituted by a plurality of convex portions protruding diametrically from an outer periphery of the sleeve 71 and provided at predetermined intervals in a circumferential direction of the sleeve 71. The rotation regulation blade 74*a* is fixed to the sleeve 71 and is moved and rotated integrally with the sleeve 71.

The rotation regulation claw 74*b* has a first claw portion 74*b*1 and a second claw portion 74*b*2, as a pair of claw portions facing each other at an interval through which the rotation regulation blade 74*a* can pass. The first claw portion 74*b*1 and the second claw portion 74*b*2 are configured to be retractable from the locus of the rotation regulation blade 74*a* by being pushed by the rotation regulation blade 74*a* according to the rotation direction of the rotation regulation blade 74*a*.

When the rotation regulation blade 74*a* of the rotation regulation part 74 is engaged to the rotation regulation claw 74*b*, the rotation of the sleeve 71 in conjunction with the rotation of the rotary shaft 72 is regulated, so that the sleeve 71 is moved in the front and rear direction by the rotating operation of the rotary shaft 72. Also, when the rotation regulation blade 74*a* is disengaged from the rotation regulation claw 74*b*, the sleeve 71 is rotated in conjunction with the rotation of the rotary shaft 72.

Figure 3A:
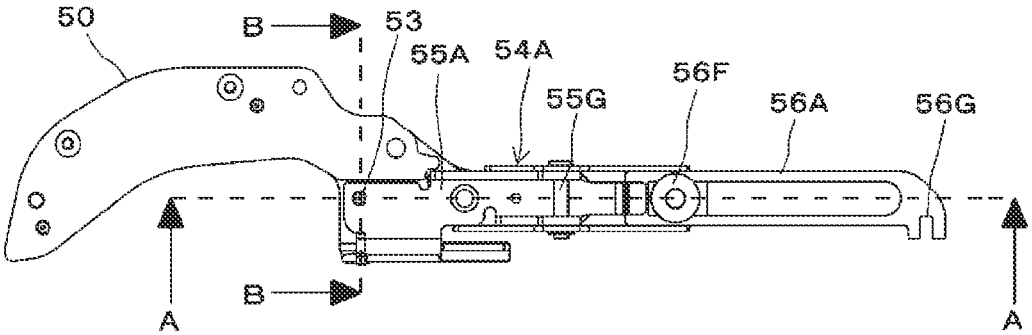
FIG. 3A is a side view showing an example of a guide member retreating mechanism of a first embodiment.
Figure 3B:
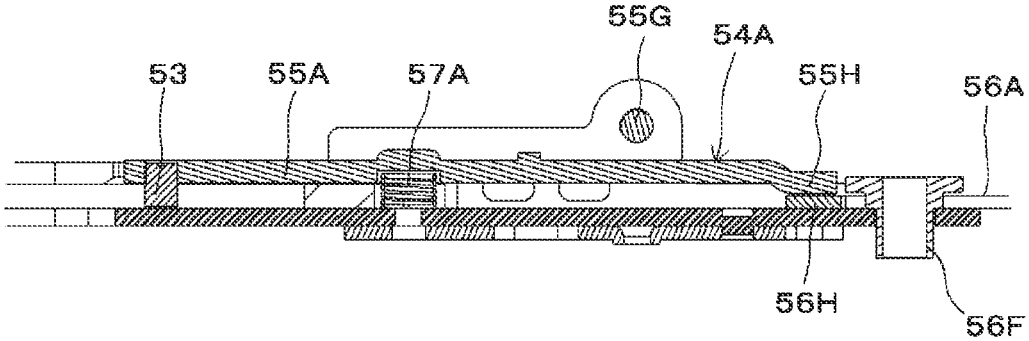
FIG. 3B is a sectional bottom view showing an example of operations of the guide member retreating mechanism of the first embodiment.
Figure 3C:
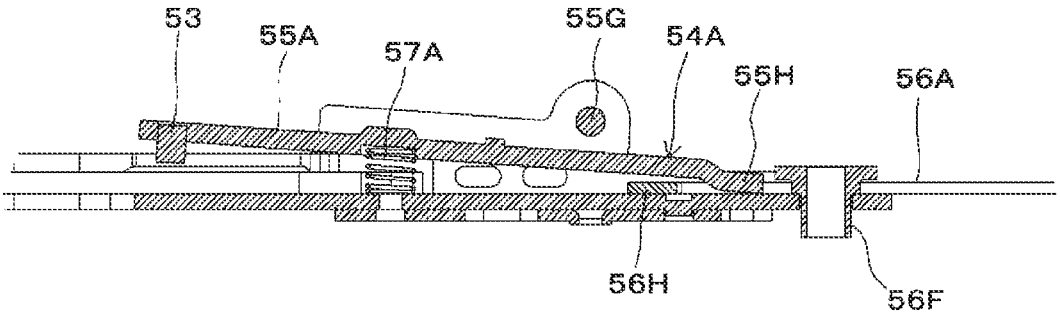
FIG. 3C is a sectional bottom view showing the example of operations of the guide member retreating mechanism of the first embodiment.
Figure 3D:
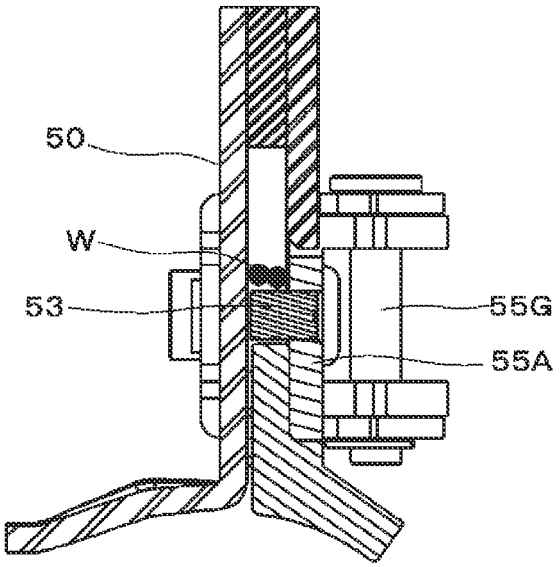
FIG. 3D is a sectional front view showing the example of operations of the guide member retreating mechanism of the first embodiment.
Figure 3E:
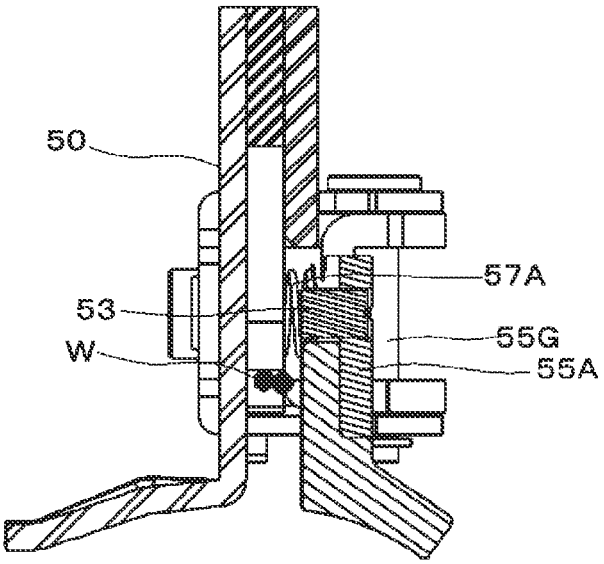
FIG. 3E is a sectional front view showing the example of operations of the guide member retreating mechanism of the first embodiment.

FIG. 3A is a side view showing an example of the guide member moving mechanism of the first embodiment, FIGS. 3B and 3C are sectional bottom views showing an example of operations of the guide member moving mechanism of the first embodiment, and FIGS. 3D and 3F, are sectional front views showing the example of operations of the guide member moving mechanism of the first embodiment. In the below, an example of the guide member moving mechanism of the first embodiment is described with reference to each drawing. Note that, FIGS. 3B and 3C are sectional views taken along an A-A line of FIG. 3A, and FIGS. 3D and 3E are sectional views taken along a B-B line of FIG. 3A.

The guide member moving mechanism 54A of the first embodiment has a guide member support part 55A to which the guide member 53 is attached, and a guide member actuating part 56A configured to actuate the guide member support part 55A.

The guide member support part 55A has a shape of extending in the axis direction of the rotary shaft 72 shown in FIGS. 2B, 2C and the like, and has a guide member 53 provided at one end portion. The guide member 53 has, in the present example, a cylindrical pin and protrudes laterally from the guide member support part 55A. A portion of the guide member support part 55A between one end portion-side and the other end portion-side is rotatably supported by a shaft 55G. An axis direction in which the shaft 55G extends is an upper and lower direction orthogonal to the extension direction of the guide member 53. The guide member support part 55A is provided on the other end portion-side with a to-be-operated portion 55H for regulating the rotating operation about the shaft 55G as a support point and releasing the regulation by being pushed by the guide member actuating part 56A.

The guide member 53 is configured to move between a guide position in which it protrudes toward the feeding path of the wire W of the curl guide 50 and curls the wire W and a retreat position in which it retreats laterally from the feeding path of the wire W of the curl guide 50 by the rotating operation of the guide member support part 55A about the shaft 55G as a support point.

The guide member actuating part 56A has a form of extending in the axis direction of the rotary shaft 72 and is supported by a guide convex portion 56F so that a portion between one end portion-side and the other end portion-side can move along a moving direction of the sleeve 71, which is the axis direction of the rotary shaft 72, The guide member actuating part 56A is configured to move in a front and rear direction, which is the axis direction of the rotary shaft 72, in conjunction with the sleeve 71 configured to move by rotation of the rotary shaft 72. The guide member actuating part 56A is also provided on one end portion-side with an operating portion 56H for pushing the to-be-operated portion 55H of the guide member support part 55A. The guide member actuating part 56A is also provided on the other end portion-side with an engaging portion 56G for engaging with the sleeve 71.

The guide member moving mechanism 54A has a spring 57A for urging the guide member support part 55A in a direction in which the guide member 53 moves to the retreat position.

As shown in FIG. 3B, the guide member moving mechanism 54A is configured so that when the guide member actuating part 56A is moved to a position in which the operating portion 56H of the guide member actuating part 56A pushes the to-be-operated portion 55H of the guide member support part 55A, the rotation of the guide member support part 55A about the shaft 55G as a support point is regulated. Thereby, as shown in FIGS. 3B and 3D, the guide member 53 is moved to the guide position.

In contrast, as shown in FIG. 3C, the guide member moving mechanism 54A is configured so that when the guide member actuating part 56A is moved to a position in which the operating portion 56H of the guide member actuating part 56A separates from the to-be-operated portion 55H of the guide member support part 55A, the regulation on the rotation of the guide member support part 55A about the shaft 55G as a support point is released. Thereby, as shown in FIGS. 3C and 3E, the guide member support part 55A is urged and rotated by the spring 57A, so that the guide member 53 is moved from the guide position to the retreat position.

Subsequently, the interlocking of the operation of the sleeve 71 and the operations of the first side hook 70R and the second side hook 70L and the guide member 53 and the movable blade part 61 is described.

In an operation area where the sleeve 71 is moved in the front and rear direction along the axis direction of the rotary shaft 72 without rotating, the first side hook 70R and the second side hook 70L are opened and closed in conjunction with the movement of the sleeve 71. In addition, the guide member 53 is moved between the guide position and the retreat position of the wire W Further, the movable blade part 61 is moved between the retreat position and the cutting position.

In the operation area where the sleeve 71 is moved in the front and rear direction along the axis direction of the rotary shaft 82 without rotating, an operation area where the first side hook 70R and the second side hook 70L are opened and closed is referred to as a first operation area. In addition, an operation area where the guide member 53 is moved between the guide position and the retreat position of the wire W is referred to as a second operation area. Further, an operation area where the movable blade part 61 is moved between the retreat position and the cutting position is referred to as a third operation area.

When the sleeve 71 is moved from a start point position of the first operation area toward an end point position of the first operation area, the first side hook 70R is closed with respect to the center hook 70C and the second side hook 70L is closed with respect to the center hook 70C, as shown in FIG. 2C.

While the sleeve 71 is moved in the first operation area, the guide member actuating part 56A is moved to a position in which the operating portion 56H of the guide member actuating part 56A pushes the to-be-operated portion 55H of the guide member support part 55A, as shown in FIG. 3B. Thereby, the rotation of the guide member support part 55A about the shaft 55G as a support point is regulated, and the guide member 53 is moved to the guide position, as shown in FIGS. 3B and 3D.

In addition, when the sleeve 71 is moved from a start point position of the second operation area, which is the end point position of the first operation area, toward an end point position of the second operation area, the guide member actuating part 56A is moved to a position in which the operating portion 56H of the guide member actuating part 56A separates from the to-be-operated portion 55H of the guide member support part 55A and the regulation on the rotation of the guide member support part 55A about the shaft 55G as a support point is released, as shown in FIG. 3C. Thereby, as shown in FIGS. 3C and 3E, the guide member support part 55A is urged and rotated by the spring 57A, and the guide member 53 is moved from the guide position to the retreat position.

Therefore, when the sleeve 71 is moved to the end point position of the first operation area, the wire W is engaged by the wire engaging body 70. In addition, when the sleeve 71 is moved to the end point position of the second operation area, the guide member 53 is moved from the guide position to the retreat position of the wire W. Further, when the sleeve 71 is moved to the end point position of the third operation area, the movable blade part 61 is moved from the retreat position to the cutting position.

When the sleeve 71 is moved to the end point position of the third operation area, the engaging of the rotation regulation blade 74*a* with the rotation regulation claw 74*b* is released. When the engaging of the rotation regulation blade 74*a* with the rotation regulation claw 74*b* is released, the sleeve 71 is rotated in conjunction with the rotation of the rotary shaft 72. The center hook 70C, the first side hook 70R and the second side hook 70 of the wire engaging body 70 engaging the wire W are rotated in conjunction with the rotation of the sleeve 71.

Figure 4:
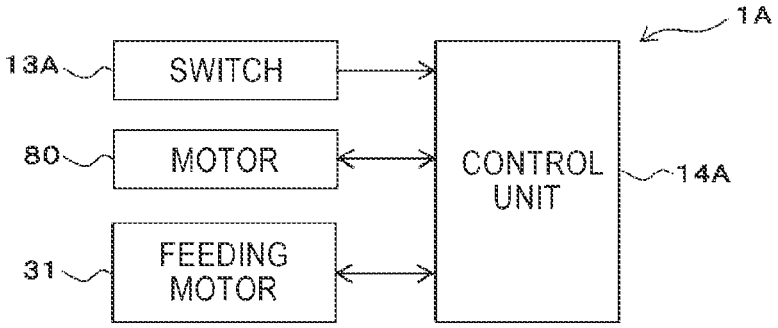
FIG. 4 is a block diagram showing an example of a control function of the reinforcing bar binding machine.

FIG. 4 is a block diagram showing an example of a control function of the reinforcing bar binding machine. In the reinforcing bar binding machine 1A, the control unit 14A is configured to control the motor 80 and the feeding motor 31 configured to drive the feeding gears 30, according to a state of the switch 13A that is pushed by an operation of the trigger 12A shown in FIG. 1. The control unit 14A is configured to control a position of the sleeve 71 by controlling a rotation amount of the motor 80. The control unit 14A is also configured to control forward and reverse rotations of the feeding motor 31.

The control unit 14A is configured to engage the wire W with the wire engaging body 70 by controlling the rotation amount of the motor 80, during an operation of moving the sleeve 71 to the end point position of the first operation area. The control unit 14A is also configured to move the guide member 53 from the guide position to the retreat position during an operation of moving the sleeve 71 to the end point position of the second operation area. The control unit 14A is also configured to cut the wire W during an operation of moving the sleeve 71 to the end point position of the third operation area.

After engaging the wire W with the wire engaging body 70, the control unit 14A links the operation of moving the guide member 53 from the guide position to the retreat position of the wire W with the operation of reversing the feeding motor 31 to feed the wire W in the reverse direction, thereby winding the wire W on the reinforcing bars S.

<Example of Operation of Reinforcing Bar Binding Machine>

FIGS. 5A to 5F show an example of an operation of binding reinforcing bars by the reinforcing bar binding machine. Subsequently, an operation of binding the reinforcing bars S with the wire W by the reinforcing bar binding machine 1A is described with reference to the respective drawings.

The reinforcing bar binding machine 1A is in a standby state where the wire W is sandwiched between the pair of feeding gears 30 and the tip end of the wire W is positioned between the sandwiched position by the feeding gears 30 and the fixed blade part 60 of the cutting unit 6A. Also, as shown in FIGS. 2A and 2B, when the reinforcing bar binding machine 1A is in the standby state, the first side hook 70R is opened with respect to the center hook 70C and the second side hook 70L is opened with respect to the center hook 70C.

When the reinforcing bars S are inserted between the curl guide 50 and the induction guide 51A of the curl forming unit 5A and the trigger 12A is operated, the control unit 14A drives the feeding motor 31 in the forward rotation direction, thereby feeding the wire W in the forward direction denoted with the arrow F by the wire feeding unit 3A.

In a configuration where a plurality of, for example, two wires W are fed, the two wires W are fed aligned in parallel along an axis direction of the loop Ru, which is formed by the wires W, by a wire guide (not shown).

The wire W fed in the forward direction passes between the center hook 70C and the first side hook 70R and is then fed to the curl guide 50 of the curl forming unit 5A. The wire W passes through the curl guide 50, so that it is curled to be wound around the reinforcing bars S.

Figure 5A:
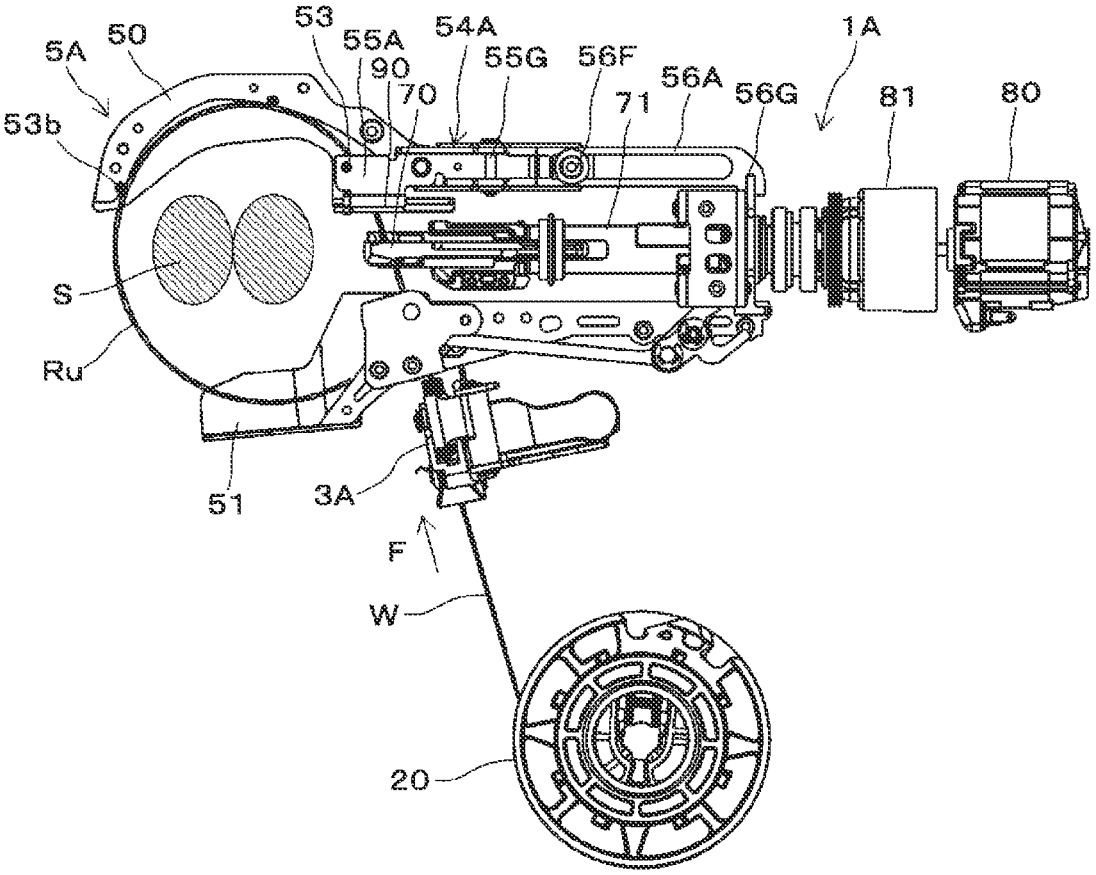
FIG. 5A illustrates an example of an operation of binding reinforcing bars by the reinforcing bar binding machine.
Figure 5B:
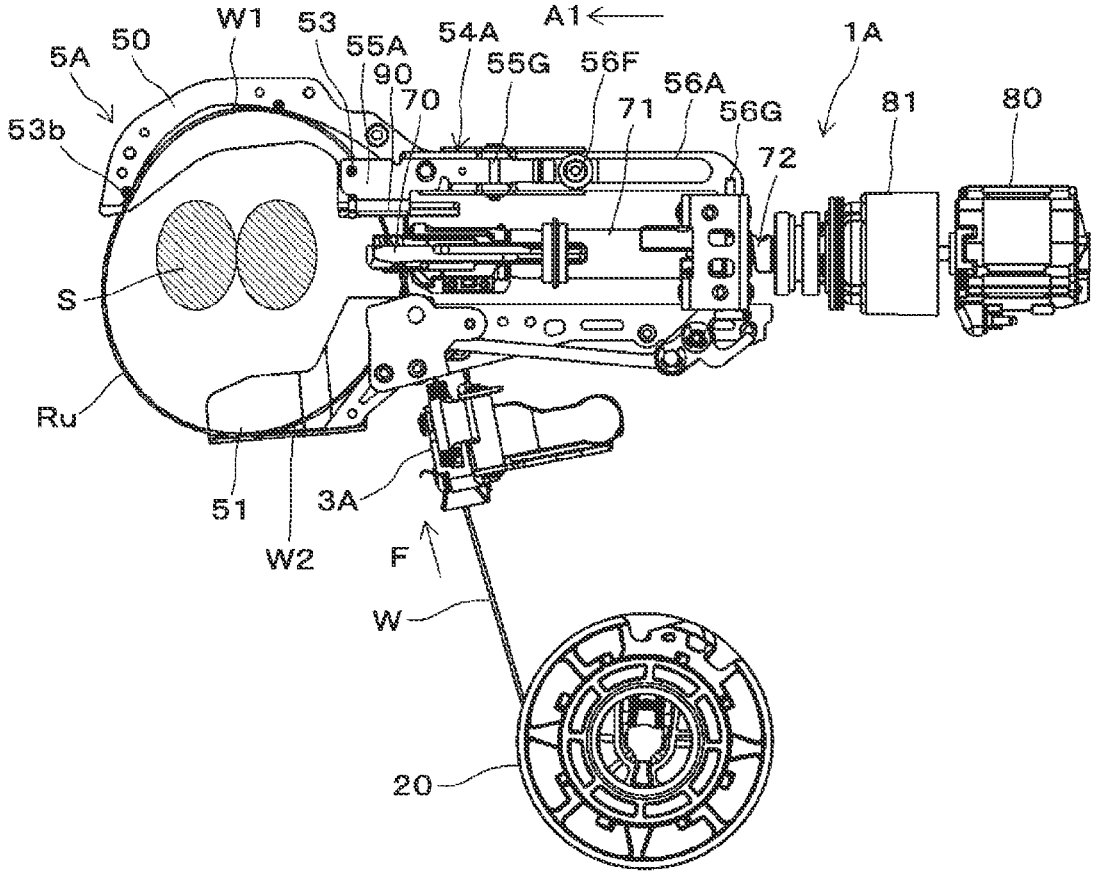
FIG. 5B illustrates the example of the operation of binding reinforcing bars by the reinforcing bar binding machine.

The wire W curled by the curl guide 50 is guided to the induction guide 51 and is further fed in the forward direction by the wire feeding unit 3A, as shown in FIG. 5A, so that the wire is guided between the center hook 70C and the second side hook 70L by the induction guide 51. The wire W is fed until the tip end is butted against the feeding regulation part 90, as shown in FIG. 5B. When the wire W is fed to a position in which the tip end is butted against the feeding regulation part 90, the control unit 14A stops the drive of the feeding motor 31.

After stopping the feeding of the wire W in the forward direction, the control unit 14A drives the motor 80 in the forward rotation direction. In the first operation area where the wire W is engaged by the wire engaging body 70, the rotation regulation blade 74*a* is engaged to the rotation regulation claw 74*b*, so that the rotation of the sleeve 71 in conjunction with the rotation of the rotary shaft 72 is regulated. Thereby, the rotation of the motor 80 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, as shown in FIG. 2C, the first side hook 70R is moved toward the center hook 70C by the rotating operation about the shaft 71*b* as a support point. When the first side hook 70R is closed with respect to the center hook 70C, the wire W sandwiched between the first side hook 70R and the center hook 70C is engaged in such an aspect that the wire can move between the first side hook 70R and the center hook 70C.

Also, the second side hook 70L is moved toward the center hook 70C by the rotating operation about the shaft 71*b* as a support point. When the second side hook 70L is closed with respect to the center hook 70C, the wire W sandwiched between the second side hook 70L and the center hook 70C is engaged is in such an aspect that the wire cannot come off from between the second side hook 70L and the center hook 70C.

After advancing the sleeve 71 to the end point position of the first operation area where the wire W is engaged by the closing operation of the first side hook 70R and the second side hook 70L, the control unit 14A temporarily stops the rotation of the motor 80 and drives the feeding motor 31 in the reverse rotation direction. Thereby, the pair of feeding gears 30 is driven in the reverse rotation direction.

Therefore, the wire W sandwiched between the pair of feeding gears 30 is fed in the reverse direction denoted with the arrow R.

The wire W wound around the reinforcing bars S and engaged by the wire engaging body 70 is engaged in such an aspect that a portion on the tip end-side sandwiched between the second side hook 70L and the center hook 70C cannot come off from between the second side hook 70L and the center hook 70C. Also, the wire W engaged by the wire engaging body 70 is engaged in such an aspect that a portion sandwiched between the first side hook 70R and the center hook 70C can move between the first side hook 70R and the center hook 70C in a circumferential direction of the loop Ru along the feeding path of the wire W but movement in a radial direction of the loop Ru of the wire W is regulated.

The wire W wound around the reinforcing bars S along the curl guide 50 and the induction guide 51 and engaged at the tip end by the wire engaging body 70 is closer to an engaging position of the wire W by the second side hook 70L and the center hook 70C at a wire W2 of a portion along the induction guide 51, which is a wire on the second side positioned on an opposite side to the curl guide 50 with respect to the reinforcing bars 5, than a wire W1 of a portion along the curl guide 50, which is a wire on the first side positioned on the curl guide 50. Note that, the wire W wound around the reinforcing bars S is closer to the wire feeding unit 3A at the wire W1 of a portion along the curl guide 50 than the wire W2 of a portion along the induction guide 51, in a direction along the feeding path of the wire W.

Thereby, in the operation of feeding the wire W in the reverse direction denoted with the arrow R, the wire W wound around the reinforcing bars S is first pulled at the wire W1 of a portion along the curl guide 50 in the direction of the wire feeding unit 3A, so that the wire is moved from the wire W1 of a portion along the curl guide 50 toward the reinforcing bars S.

In the meantime, in a case where the sleeve 71 is located in the end point position of the first operation area, the guide member 53 configured to open/close in conjunction with movement of the sleeve 71 is not retreated from the guide position of the wire W, and protrudes toward the radially inner side of the loop Ru of the wire W wound around the reinforcing bars S, as shown in FIGS. 3B and 3D.

Figure 5C:
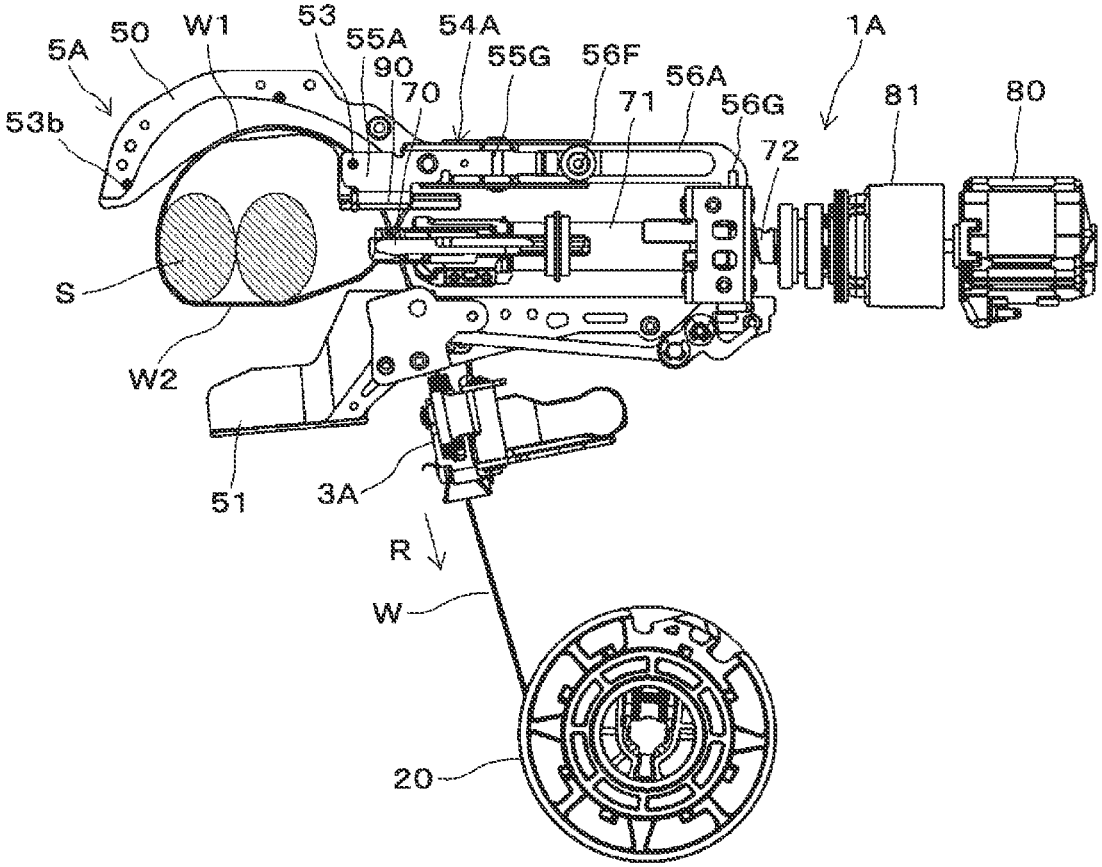
FIG. 5C illustrates the example of the operation of binding reinforcing bars by the reinforcing bar binding machine.

Thereby, as shown in FIG. 5C, in the operation of feeding the wire W in the reverse direction denoted with the arrow R, the wire W1 of a portion along the curl guide 50 cannot enter the inner side from the guide member 53. In this state, the wire W is fed in the reverse direction, so that the wire W2 of a portion along the induction guide 51 is pulled toward the curl guide 50 and the wire W2 of a portion along the induction guide 51 comes close to the reinforcing bars S.

When the feeding motor 31 is reversely rotated until the wire W is pulled back by a predetermined amount and the wire W2 on a side along the induction guide 51 comes into contact with the reinforcing bars 5, the control unit 14A stops the drive of the feeding motor 31 in the reverse rotation direction. The timing at which the feeding of the wire W in the reverse direction is stopped is determined by the control unit 14A, based on any one or a combination of elapse of time after the drive of the feeding motor 31 in the reverse rotation direction is started, a feeding amount of the wire W detected by an amount of rotation of the feeding motor 31 and the like, and a load applied to the wire W detected by a load applied to the feeding motor 31 and the like.

Figure 5D:
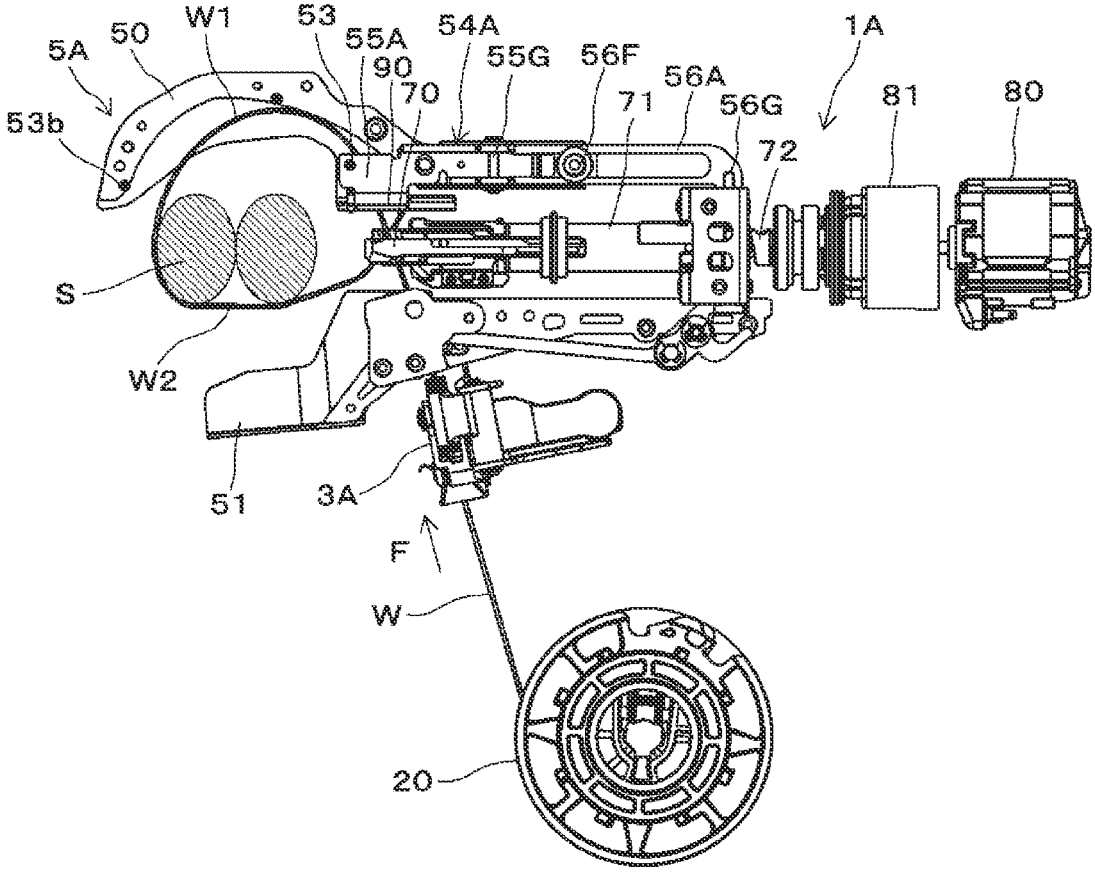
FIG. 5D illustrates the example of the operation of binding reinforcing bars by the reinforcing bar binding machine.

After stopping the drive of the feeding motor 31 in the reverse rotation direction, the feeding motor 31 is driven in the forward rotation direction, so that the wire W1 on the curl guide 50-side is loosened, as shown in FIG. 5D. As a result, if the guide member 53 is pressed by the wire W, it is solved.

Figure 5E:
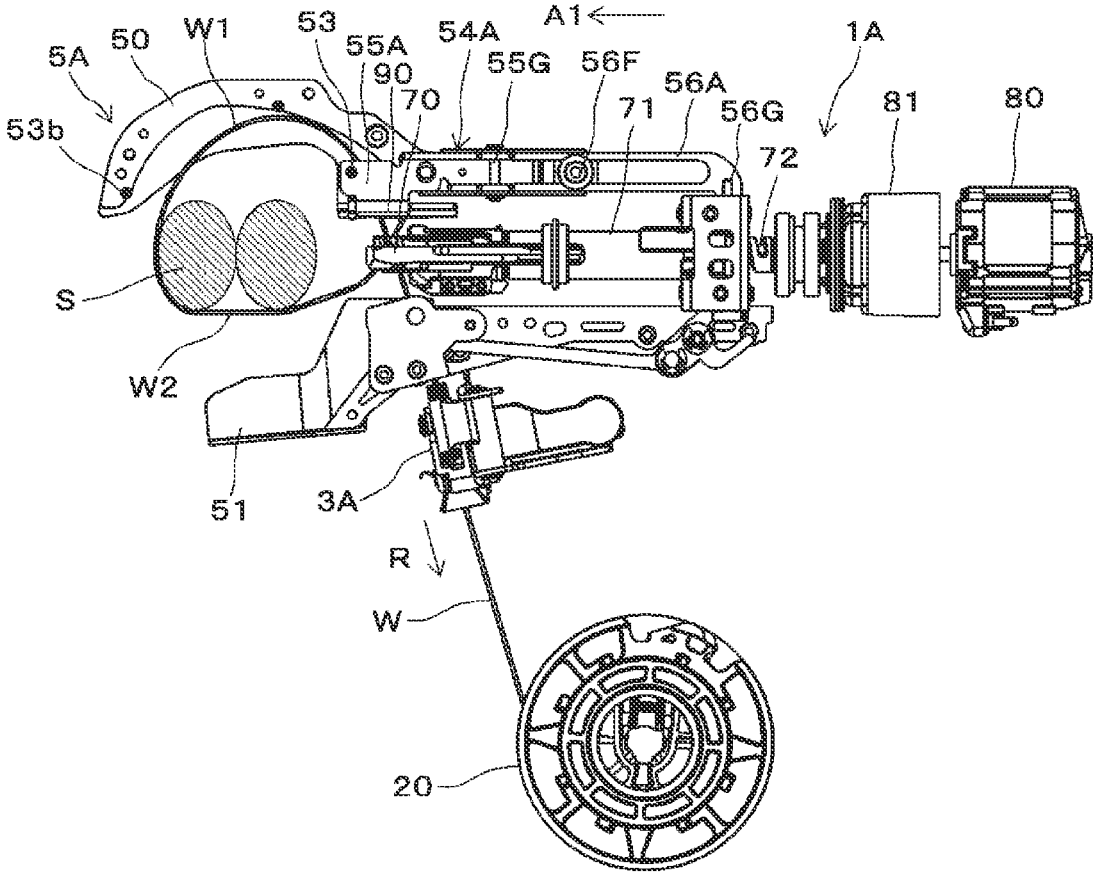
FIG. 5E illustrates the example of the operation of binding reinforcing bars by the reinforcing bar binding machine.

When the feeding motor 31 is forward rotated until the wire W1 on the curl guide 50-side is loosened by a predetermined amount, the control unit 14A stops the drive of the feeding motor 31 in the forward rotation direction and then drives the motor 80 in the forward rotation direction. Thereby, as shown in FIG. 5E, the sleeve 71 is moved in the forward direction denoted with the arrow A1 to the end point position of the second operation area where the guide member 53 is moved from the guide position to the retreat position.

When the sleeve 71 is moved in the forward direction denoted with the arrow A1 to the end point position of the second operation area, the guide member 53 is retreated from the guide position of the wire W, as shown in FIGS. 3C and 3E. Before the operation of retreating the guide member 53, the wire W on the curl guide 50-side is loosened, so that if the guide member 53 is pressed by the wire W, it is solved. By doing so, the load by the wire W is suppressed from being applied to the guide member 53, so that the guide member 53 is securely moved to the retreat position.

When the motor 80 is forward rotated until the sleeve 71 is moved to the end point position of the second operation area, the control unit 14A stops the drive of the motor 80 in the forward rotation direction and then drives the feeding motor 31 in the reverse rotation direction, thereby feeding the wire W in the reverse direction denoted with the arrow R.

When the sleeve 71 is moved to the end point position of the second operation area, the guide member 53 configured to open and close in conjunction with the movement of the sleeve 71 is moved from the guide position to the retreat position of the wire W, as described above. Therefore, there is no protrusion that hinders the movement of the wire W toward the radially inner side of the loop Ru of the wire W wound around the reinforcing bars S.

Figure 5F:
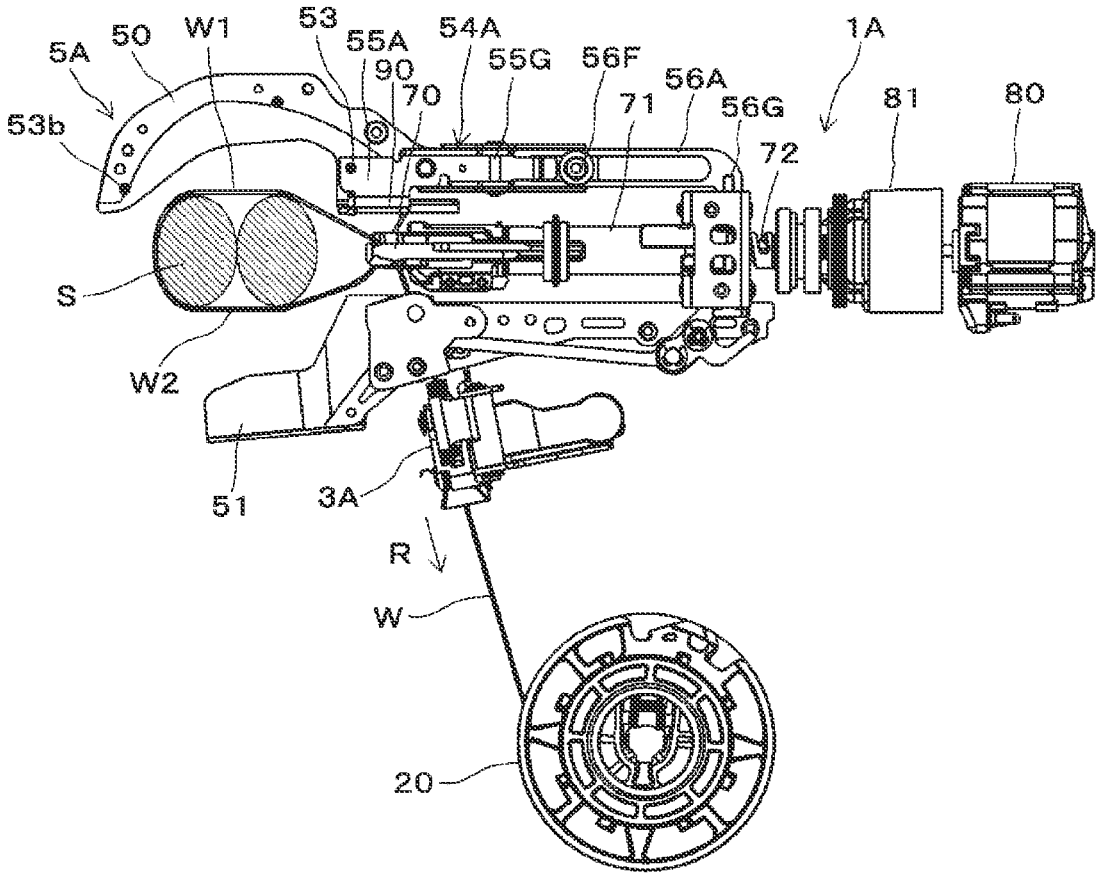
FIG. 5F illustrates the example of the operation of binding reinforcing bars by the reinforcing bar binding machine.

Thereby, as shown in FIG. 5F, in the operation of feeding the wire W in the reverse direction, the wire W1 on a side along the curl guide 50 is pulled toward the wire feeding unit 3A, so that the wire W is moved toward the reinforcing bars S and is wound on the reinforcing bars S.

When the wire W is pulled back to a position in which the wire is wound on the reinforcing bars S, the control unit 14A stops the drive of the feeding motor 31 in the reverse rotation direction and then drives the motor 80 in the forward rotation direction, thereby moving the sleeve 71 in the forward direction denoted with the arrow A1. When the operation of moving the sleeve 71 in the forward direction is transmitted to the cutting unit 6A by the transmission mechanism 62, so that the movable blade part 61 is rotated and the sleeve 71 is moved to the end point position of the third operation area, the wire W engaged by the first side hook 70R and the center hook 70C is cut by the operation of the fixed blade part 60 and the movable blade part 61.

The bending portions 71*c*1 and 71*c*2 are moved toward the reinforcing bars S substantially at the same time when the wire W is cut. Thereby, the tip end-side of the wire W engaged by the center hook 70C and the second side hook 70L is pressed toward the reinforcing bars S and bent toward the reinforcing bars S at the engaging position as a support point by the bending portion 71*c*1. The sleeve 71 is further moved in the forward direction, so that the wire W engaged between the second side hook 70L and the center hook 70C is maintained sandwiched by the bending portion 71*c*1.

Also, the terminal end-side of the wire W engaged by the center hook 70C and the first side hook 70R and cut by the cutting unit 6A is pressed toward the reinforcing bars S and bent toward the reinforcing bars S at the engaging position as a support point by the bending portion 71*c*2. The sleeve 71 is further moved in the forward direction, so that the wire W engaged between the first side hook 70R and the center hook 70C is maintained sandwiched by the bending portion 71*c*2.

After the tip end-side and the terminal end-side of the wire W are bent toward the reinforcing bars S, the motor 80 is further driven in the forward rotation direction, so that the sleeve 71 is further moved in the forward direction. When the sleeve 71 is moved to a predetermined position and reaches the operation area where the wire W engaged by the wire engaging body 70 is twisted, the engaging of the rotation regulation blade 74*a* with the rotation regulation claw 74*b* is released.

Thereby, the motor 80 is further driven in the forward rotation direction, so that the wire engaging body 70 is rotated in conjunction with the rotary shall 72, thereby twisting the wire W.

In the binding unit 7A, in the operation area where the sleeve 71 rotates, the reinforcing bars S are bulled against the bulling part 91, so that the backward movement of the reinforcing bars S toward the binding unit 7A is regulated. Therefore, the wire W is twisted, so that a force of pulling the wire engaging body 70 forward along the axis direction of the rotary shaft 72 is applied.

When the force of moving the wire engaging body 70 forward along the axis direction of the rotary shaft 72 is applied to the wire engaging body 70, the rotary shaft 72 can move forward while receiving a force pushed backward by the spring 72*c*. Thereby, in the binding unit 7A, in the operation area where the sleeve 71 rotates, the wire engaging body 70 and the rotary shaft 72 twist the wire W while moving forward.

When a load applied to the motor 80 is detected and the load applied to the motor becomes a predetermined value, for example, a maximum value, the control unit 14A stops the rotation of the motor 80 in the forward direction at a predetermined timing.

Then, the control unit 14A reversely rotates the motor 80. When the motor 80 is driven in the reverse rotation direction, the rotation regulation blade 74*a* is engaged to the rotation regulation claw 74*b*, so that the rotation of the sleeve 71 in conjunction with the rotation of the rotary shaft 72 is regulated. Thereby, the sleeve 71 is moved in the backward direction denoted with the arrow A2.

When the sleeve 71 is moved backward, the bending portions 71*c*1 and 71*c*2 separate from the wire W and the engaged state of the wire W by the bending portions 71*c*1 and 71*c*2 is released. Also, when the sleeve 71 is moved backward, the opening/closing pin 71*a* passes through the opening/closing guide holes 73. Thereby, the first side hook 70R is moved away from the center hook 70C by the rotating operation about the shaft 71*b* as a support point. The second side hook 70L is also moved away from the center hook 70C by the rotating operation about the shaft 71*b* as a support point. Thereby, the wire W comes off from the wire engaging body 70.

<Example of Operational Effects of Reinforcing Bar Binding Machine>

In the binding machine of the related art, in a state where the wire W is wound around the reinforcing bars S along the curl guide 50 and the induction guide 51, after the wire W is engaged by the wire engaging body 70, the wire W is fed in the reverse direction in the state where the guide member 53 is moved from the guide position to the retreat position of the wire W.

In this case, the wire is moved toward the reinforcing bars S from the wire W1 of a portion along the curl guide 50 close to the wire feeding unit 3A in the direction along the feeding path of the wire W wound around the reinforcing bars S along the curl guide 50 and the induction guide 51. When the wire W1 of a portion along the curl guide 50 is moved to a position in which the wire comes into contact with the reinforcing bars S, the load of feeding the wire W in the reverse direction increases due to the friction between the wire W and the reinforcing bars S. For this reason, the wire W2 of a portion along the induction guide 51 positioned on an opposite side to the curl guide 50 with respect to the reinforcing bars S cannot be sufficiently pulled back, so that the wire W may not be wound on the reinforcing bars S.

In contrast, according to the reinforcing bar binding machine 1A of the present embodiment, as described above, in a state where the wire W is wound around the reinforcing bars S along the curl guide 50 and the induction guide 51, after the wire W is engaged by the wire engaging body 70, the wire W is fed in the reverse direction in the state where the guide member 53 protrudes to the guide position of the wire W.

Thereby, of the wire W wound around the reinforcing bars S and engaged by the wire engaging body 70, the wire of a portion that is close to the wire feeding unit 3A and can move in the circumferential direction of the loop Ru along the feeding path of the wire W, i.e., the wire W1 of a portion along the curl guide 50 is restricted from moving toward the reinforcing bars S by the guide member 53. In this state, the wire of a portion close to the tip end-side of the wire W, which is engaged by the wire engaging body 70 and thus has not moved in the circumferential direction of the loop Ru along the feeding path of the wire W, i.e., the wire W2 of a portion along the induction guide 51 positioned on the opposite side to the curl guide 50 with respect to the reinforcing bars S is moved toward the reinforcing bars S, so that the wire W2 of a portion along the induction guide 51 is brought into contact with the reinforcing bars S. Then, the wire W is further fed in the reverse direction in a state where the guide member 53 is moved from the guide position to the retreat position of the wire W. Thereby, as shown in FIG. 5F, the wire W1 of a portion along the curl guide 50 is moved toward the reinforcing bars S to cause the wire W1 of a portion along the curl guide 50 to contact the reinforcing bars S, so that the wire W can be securely wound on the reinforcing bars S.

<Modified Embodiment of Reinforcing Bar Binding Machine>

Figure 6A:
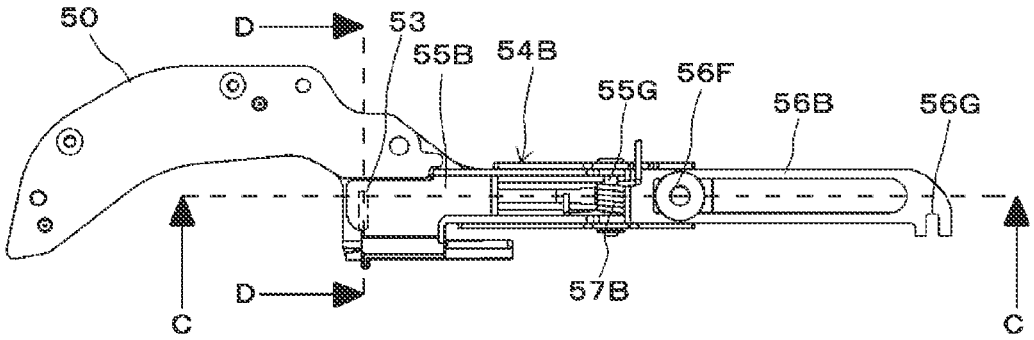
FIG. 6A is a side view showing an example of a guide member retreating mechanism of a second embodiment.
Figure 6B:
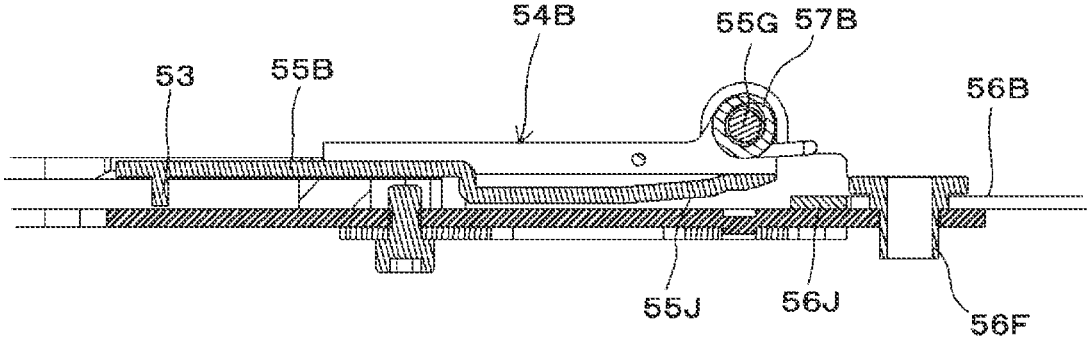
FIG. 6B is a sectional bottom view showing an example of operations of the guide member retreating mechanism of the second embodiment.
Figure 6C:
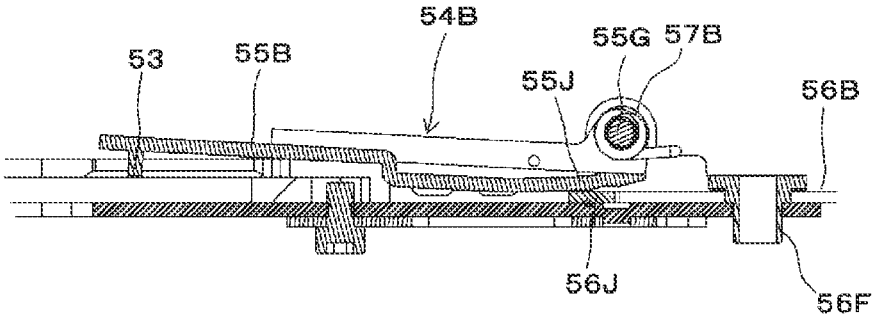
FIG. 6C is a sectional bottom view showing the example of operations of the guide member retreating mechanism of the second embodiment.
Figure 6D:
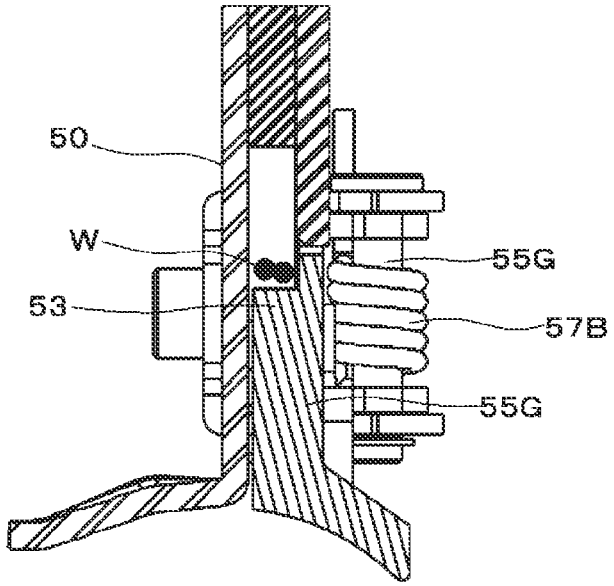
FIG. 6D is a sectional front view showing the example of operations of the guide member retreating mechanism of the second embodiment.
Figure 6E:
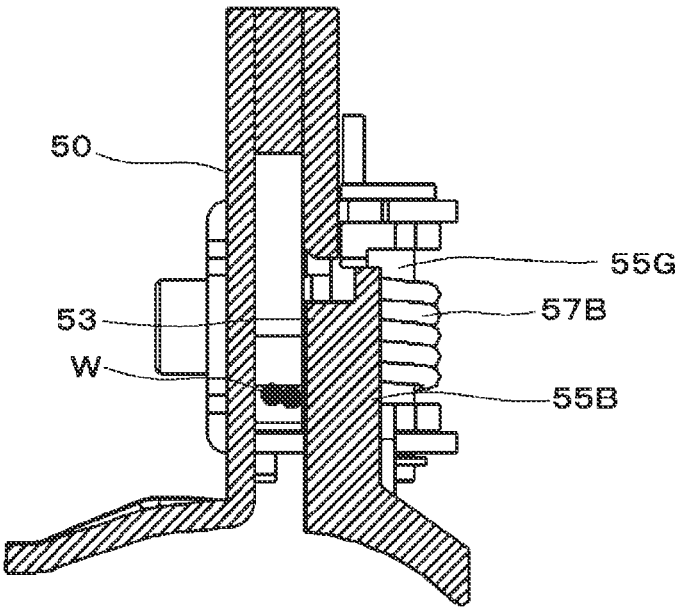
FIG. 6E is a sectional front view showing the example of operations of the guide member retreating mechanism of the second embodiment.

FIG. 6A is a side view showing an example of a guide member moving mechanism of a second embodiment, FIGS. 6B and 6C are sectional bottom view showing an example of operations of the guide member moving mechanism of the second embodiment, and FIGS. 6D and 6E are sectional front views showing the example of operations of the guide member moving mechanism of the second embodiment. Subsequently, an example of the guide member moving mechanism of the second embodiment is described with reference to the respective drawings. Note that, FIGS. 6B and 6C are sectional views taken along a C-C line of FIG. 6A, and FIGS. 6D and 6E are sectional views taken along a D-D line of FIG. 6A.

While the guide member moving mechanism 54A of the first embodiment is configured to move the guide member 53 to the retreat position by the force of the spring, a guide member moving mechanism 54B of the second embodiment is configured to move the guide member 53 to the guide position by the force of the spring.

The guide member moving mechanism 54B of the second embodiment has a guide member support part 55B to which the guide member 53 is attached, and a guide member actuating part 56B configured to actuate the guide member support part 55B.

The guide member support part 55B has a form of extending in the axis direction of the rotary shaft 72 shown in FIGS. 2B, 2C and the like, and is provided at one end portion with the guide member 53. The guide member 53 has, for example, a cuboid shape, and protrudes laterally from the guide member support part 55B. A portion of the guide member support part 55B between one end portion-side and the other end portion-side is rotatably supported by the shaft 55G. The axis direction that is an extension direction of the shaft 55G is an upper and lower direction orthogonal to the extension direction of the guide member 53. The guide member support part 55B is provided on the other end portion-side with a to-be-operated portion 55J for performing the rotating operation about the shaft 55G as a support point and releasing the rotating operation by being pushed by the guide member actuating part 56B.

The guide member 53 is configured to move between a guide position in which it protrudes toward the feeding path of the wire W of the curl guide 50 and curls the wire W and a retreat position in which it retreats laterally from the feeding path of the wire W of the curl guide 50 by the rotating operation of the guide member support part 55B about the shaft 55G as a support point.

The guide member actuating part 56B has a form of extending in the axis direction of the rotary shaft 72 and is supported by the guide convex portion 56F so that a portion between one end portion-side and the other end portion-side can move along a moving direction of the sleeve 71, which is the axis direction of the rotary shaft 72. The guide member actuating part 56B is configured to move in the front and rear direction, which is the axis direction of the rotary shaft 72, in conjunction with the sleeve 71 configured to move by rotation of the rotary shaft 72. The guide member actuating part 56B is also provided on one end portion-side with an operating portion 56J for pushing the to-be-operated portion 55J of the guide member support part 55B. The guide member actuating part 56B is also provided on the other end portion-side with an engaging portion 56G for engaging with the sleeve 71.

The guide member moving mechanism 54B has a spring 57B for urging the guide member 55A in a direction in which the guide member 53 moves to the guide position. The spring 57B is constituted by a tortional coil spring, and is attached to the shaft 55G.

As shown in FIG. 6B, the guide member moving mechanism 54B is configured so that when the guide member actuating part 56B is moved to a position in which the operating portion 56J of the guide member actuating part 56B separates from the to-be-operated portion 55J of the guide member support part 55B, the regulation on the rotation of the guide member support part 55B about the shaft 55G as a support point is released. Thereby, as shown in FIGS. 6B and 6D, the guide member 53 is urged by the spring 57B and is moved to the guide position.

In contrast, as shown in FIG. 6C, the guide member moving mechanism 54B is configured so that when the guide member actuating part 56B is moved to a position in which the operating portion 56J of the guide member actuating part 56B pushes the to-be-operated portion 55J of the guide member support part 55B, the guide member support part 55B is pushed and rotated by the guide member actuating part 56B and the rotation of the guide member support part 55B by the spring 57B is regulated. Thereby, as shown in FIGS. 6C and 6E, the guide member 53 is moved from the guide position to the retreat position.

Figure 7A:
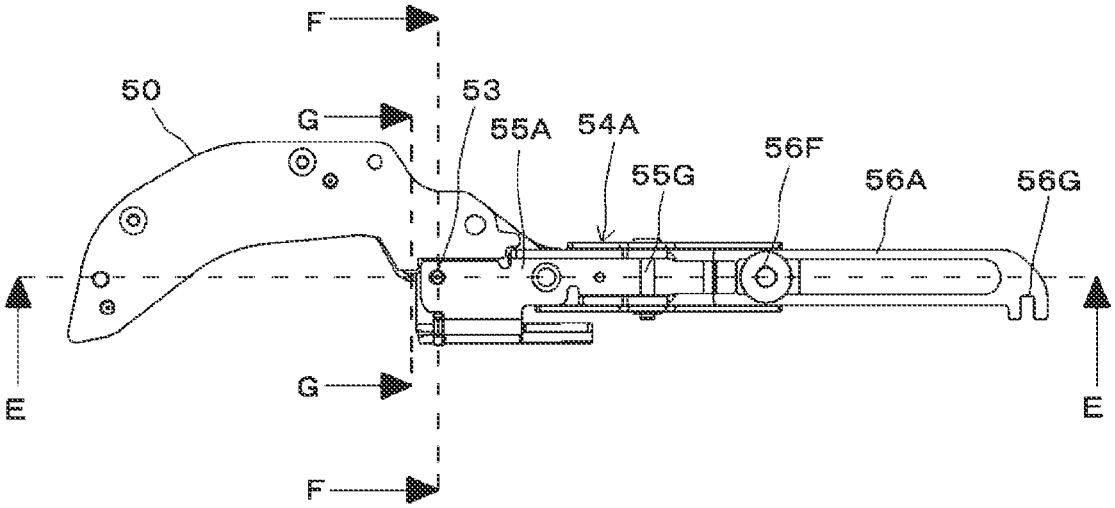
FIG. 7A is a side view showing an example of a guide member retreating mechanism of a third embodiment.
Figure 7B:
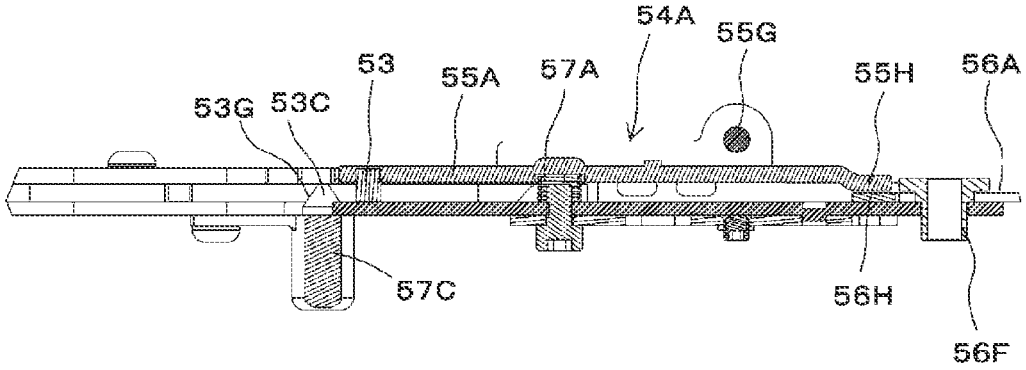
FIG. 7B is a sectional bottom view showing an example of operations of the guide member retreating mechanism of the third embodiment.
Figure 7C:
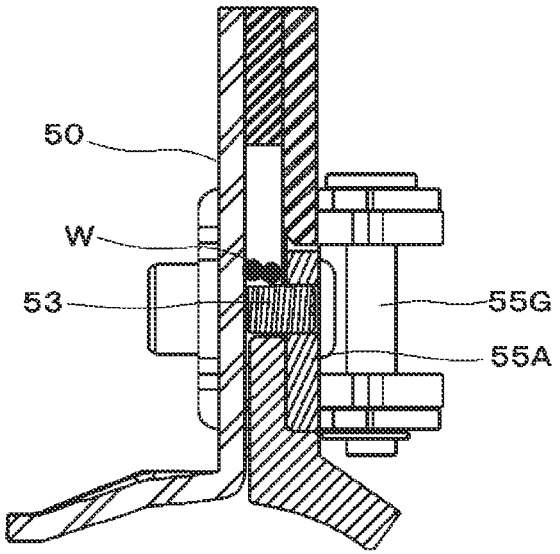
FIG. 7C is a sectional front view showing the example of operations of the guide member retreating mechanism of the third embodiment.
Figure 7D:
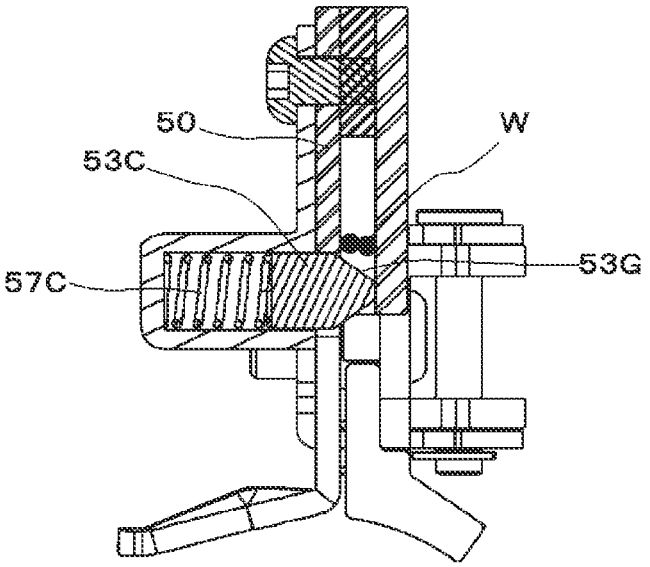
FIG. 7D is a sectional front view showing an example of operations of the guide member retreating mechanism of the third embodiment.
Figure 7E:
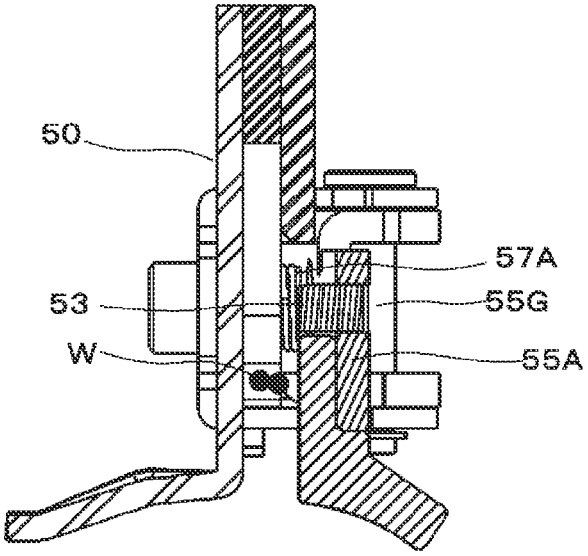
FIG. 7E is a sectional front view showing the example of operations of the guide member retreating mechanism of the third embodiment.
Figure 7F:
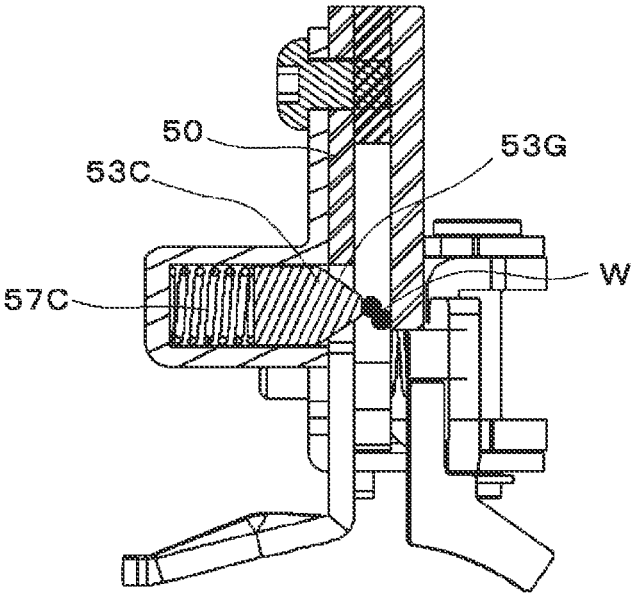
FIG. 7F is a sectional front view showing the example of operations of the guide member retreating mechanism of the third embodiment.

FIG. 7A is a side view showing an example of a guide member moving mechanism of a third embodiment, FIG. 7B is a sectional bottom view showing an example of operations of the guide member moving mechanism of the third embodiment, and FIGS. 7C to 7F are sectional front views showing the example of operations of the guide member moving mechanism of the third embodiment. Subsequently, an example of the guide member moving mechanism of the third embodiment is described with reference to the respective drawings. Note that, FIG. 7B is a sectional view taken along an E-E line of FIG. 7A, FIGS. 7C and 7E are sectional views taken along an F-F line of FIG. 7A, and FIGS. 7D and 7F are sectional views taken along a G-G line of FIG. 7A.

A guide member moving mechanism 54C of the third embodiment includes a guide member 53C configured to regulate movement of the wire W during pullback of the wire W, in addition to the guide member 53 configured to curl the wire W. The guide member 53C constitutes a pulling unit for pulling the wire W from a predetermined side by cooperation with the wire feeding unit 3A, and the guide member 53C is configured to operate independently of the sleeve 71. Note that, the guide member moving mechanism 54A configured to move the guide member 53 may be the same as the configuration described with reference to FIGS. 3A to 3E.

The guide member moving mechanism 54C of the third embodiment has a spring 57C for urging the guide member 53C in a direction of moving the guide member 53C to the guide position in which movement of the wire W is regulated when pulling back the wire W. The guide member 53C has an induction part 53G having a tapered shape on a tip end-side with which the wire W is brought into contact, and configured to generate a force for movement from the guide position to the retreat position. When the wire W is brought into contact with the induction part 53G of the guide member 53C upon pullback of the wire W, a force of pushing the guide member 53C in the direction of moving the same from the guide position to the retreat position is generated.

The operation of the guide member moving mechanism 54A moving the guide member 53 is as described above. As shown in FIG. 7B, when the guide member actuating part 56A is moved to a position in which the operating portion 56H of the guide member actuating part 56A pushes the to-be-operated portion 55H of the guide member support part 55A, the rotation of the guide member support part 55A about the shaft 55G as a support point is regulated. Thereby, as shown in FIG. 7C, the guide member 53 is moved to the guide position.

In contrast, when the guide member actuating part 56A is moved to a position in which the operating portion 56H of the guide member actuating part 56A separates from the to-be-operated portion 55H of the guide member support part 55A, the regulation on the rotation of the guide member support part 55B about the shaft 55G as a support point is released. Thereby, as shown in FIG. 7E, the guide member support part 55A is urged and rotated by the spring 57A, and the guide member 53 is moved from the guide position to the retreat position.

When the wire W is fed and pulled back in the reverse direction in a state where the guide member 53 is moved to the retreat position, the guide member 53C is moved to the guide position, as shown in FIG. 7D, so that the wire W of a portion along the curl guide 50 is restricted from moving toward the reinforcing bars S by the guide member 53C. Thereby, the wire W of a portion along the induction guide 51 is first moved toward the reinforcing bars S and can be thus contacted to the reinforcing bars S.

The wire W is further fed in the reverse direction from the state where the wire W is in contact with the guide member 53C, so that the induction part 53G generates a force of pushing the guide member 53C in the direction of moving the same from the guide position to the retreat position and the guide member 53C is moved to the retreat position while compressing the spring 57C, as shown in FIG. 7F. Thereby, the wire W of a portion along the curl guide 50 moves toward the reinforcing bars S beyond the guide member 53C and can be contacted to the reinforcing bars S.

Figure 8A:
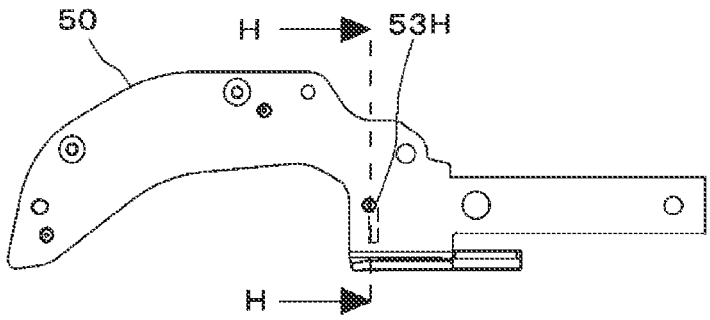
FIG. 8A is a side view showing an example of a guide member of another modified embodiment.
Figure 8B:
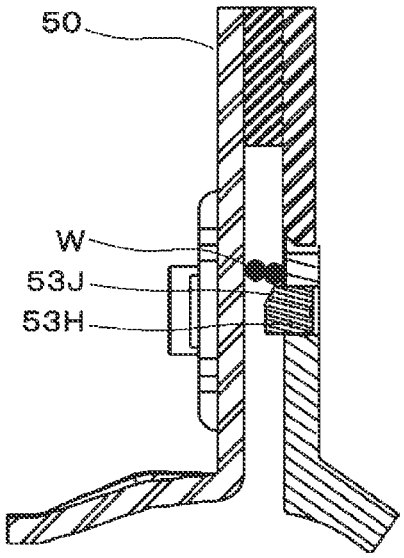
FIG. 8B is a sectional front view showing an example of operations of the guide member of another modified embodiment.

FIG. 8A is a side view showing an example of a guide member of another modified embodiment, and FIG. 8B is a sectional front view showing an example of operations of the guide member of another modified embodiment. Subsequently, an example of the guide member of another modified embodiment is described with reference to the respective drawings. Note that, FIG. 8B is a sectional view taken along an H-H line of FIG. 8A.

A guide member 53H of another modified embodiment is arranged in a position in which the wire W is curled, and is fixed to the curl guide 50. The guide member 53H is configured to restrict movement of the wire W when pulling back the wire W, and constitutes a pulling unit for pulling the wire W from a predetermined side by cooperation with the wire feeding unit 3A.

The guide member 53H has an induction part 53J having a tapered shape at a part with which the wire W fed in the reverse direction by the wire feeding unit 3A is brought into contact and configured to guide the wire W. The guide member 53H is configured to guide the wire W wound around the reinforcing bars S toward a radially inner side of the loop Ru formed by the wire W wound around the reinforcing bars S, as the wire W led in the reverse direction by the wire feeding unit 3A is brought into contact with the induction part 53J. The guide member 53H has a gap formed between the induction part 53J and the facing curl guide 50, through which the wire W can pass.

When the wire W wound around the reinforcing bars S is fed and pulled back in the reverse direction, the wire W is contacted to the guide member 53H, so that the wire W of a portion along the curl guide 50 is restricted from moving toward the reinforcing bars S by the guide member 53H. Thereby, the wire W of a portion along the induction guide 51 is first moved toward the reinforcing bars S and can be thus contacted to the reinforcing bars S.

The wire W is further fed in the reverse direction from the state where the wire W is in contact with the guide member 53H, so that the wire W in contact with the guide member 53H is guided toward the radially inner side of the loop Ru formed by the wire W wound around the reinforcing bars S while following a shape of the induction part 53J. Thereby, the wire W of a portion along the curl guide 50 can move toward the reinforcing bars S beyond the guide member 53H and can be contacted to the reinforcing bars S.

Figure 9:
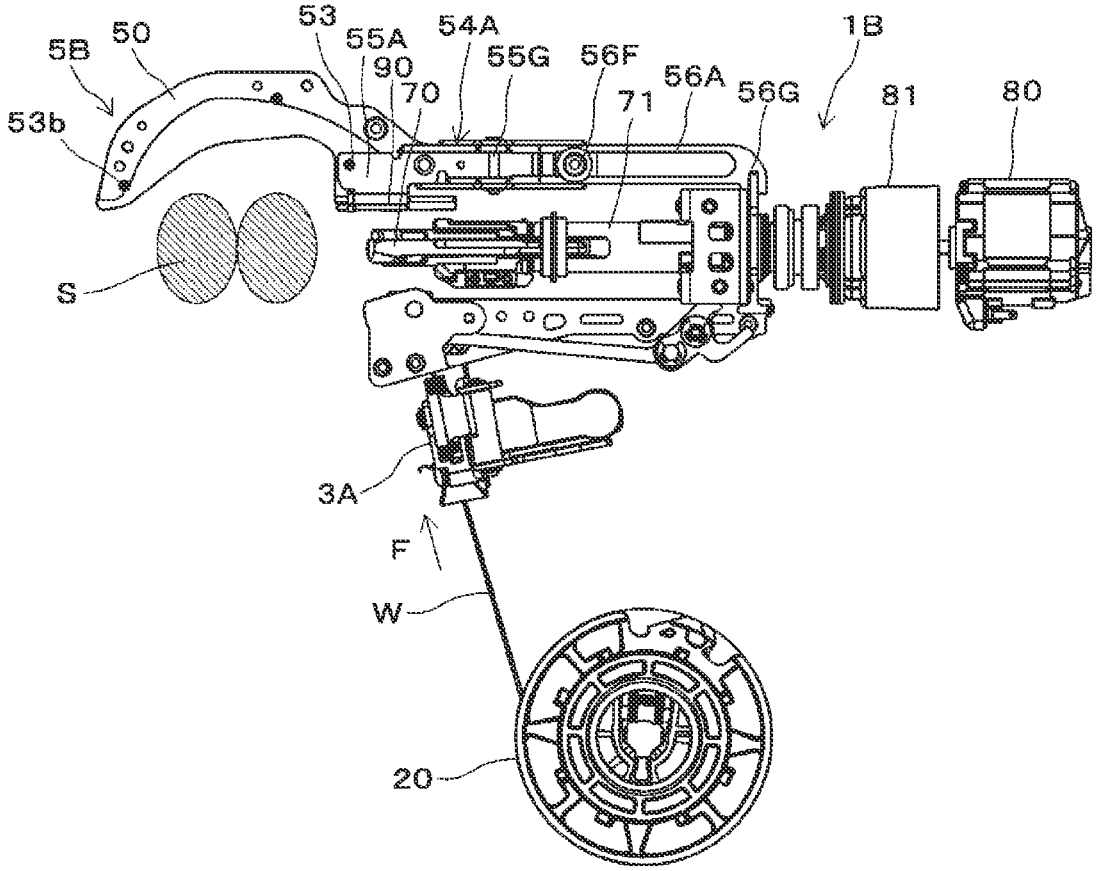
FIG. 9 is a side view of main parts showing a modified embodiment of the binding machine.

FIG. 9 is a side view of main parts showing a modified embodiment of the binding machine. A binding machine 1B of the modified embodiment has a configuration where a curl forming unit 5B has the curl guide 50, which is an example of the first guide part, and does not have the induction guide 51 shown in FIG. 1 and the like, which is an example of the second guide part.

The curl guide 50 is configured to curl the wire W that is fed by the wire feeding unit 3A, and to guide the wire W to the binding unit 7A, thereby winding the wire W around the reinforcing bars S.

In the binding machine 1B, in a state where the wire W is wound around the reinforcing bars S along the curl guide 50, the wire W is engaged by the wire engaging body 70, and then the wire W is fed in the reverse direction in a state where the guide member 53 protrudes to the guide position of the wire W.

Thereby, of the wire W wound around the reinforcing bars S and engaged by the wire engaging body 70, the wire of a portion that is close to the wire feeding unit 3A and can move in the circumferential direction of the loop Ru along the feeding path of the wire W, i.e., the wire W of a portion along the curl guide 50 is restricted from moving toward the reinforcing bars S by the guide member 53. In this state, the wire of a portion close to the tip end-side of the wire W, which is engaged by the wire engaging body 70 and thus has not moved in the circumferential direction of the loop Ru along the feeding path of the wire W, i.e., the wire W positioned on the opposite side to the curl guide 50 with respect to the reinforcing bars S is moved toward the reinforcing bars S and is brought into contact with the reinforcing bars S. Then, the wire W is further fed in the reverse direction in a state where the guide member 53 is moved from the guide position to the retreat position of the wire W. Thereby, the wire W of a portion along the curl guide 50 is moved toward the reinforcing bars S to cause the wire to contact the reinforcing bars S, so that the wire W can be securely wound on the reinforcing bars S.

Figure 10:
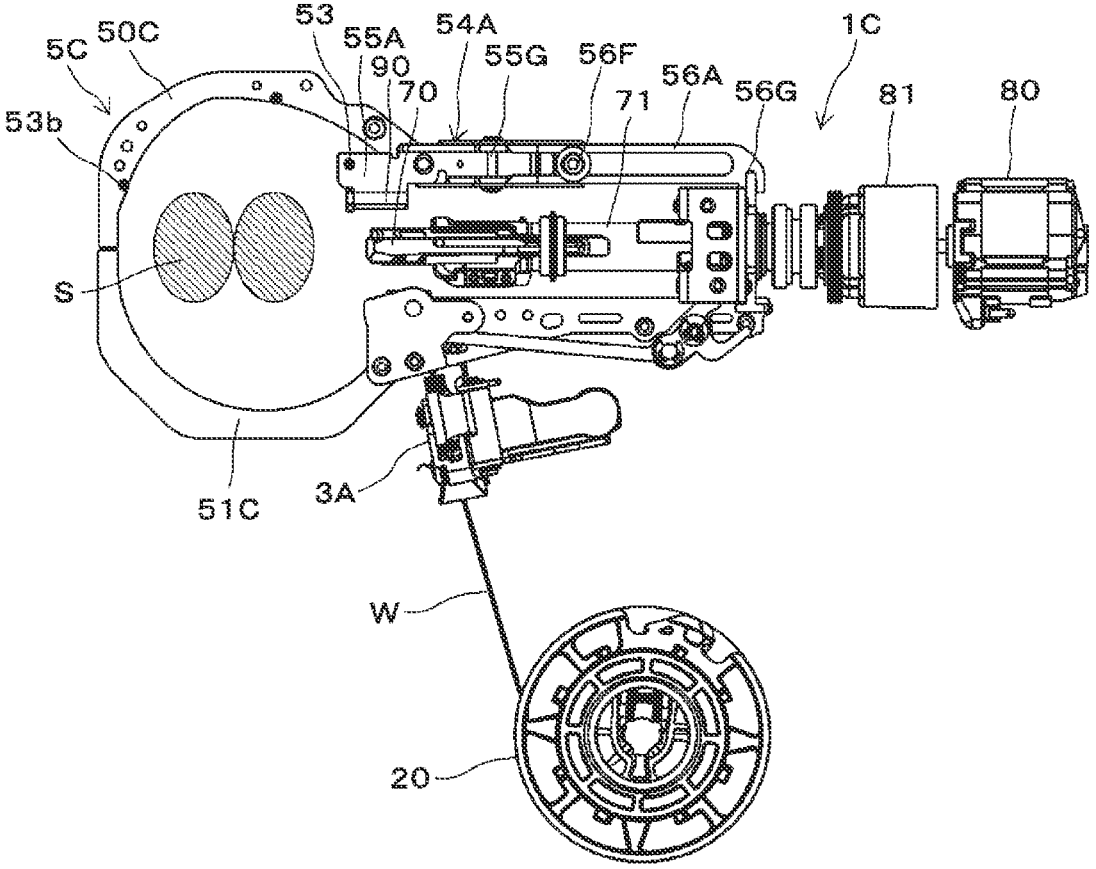
FIG. 10 is a side view of main parts showing another modified embodiment of the binding machine.

FIG. 10 is a side view of main parts showing another modified embodiment of the binding machine. In a binding machine 1C of another modified embodiment, a curl forming unit 5C has a curl guide 50C and an induction guide 51C. The curl forming unit 5C is configured to open and close as at least one of the curl guide 50C and the induction guide 51C is moved in a direction of contacting/separating with respect to the other. In a state where the curl guide 50C and the induction guide 51C are closed, the curl guide 50C and the induction guide 51C are connected to each other.

The curl guide 50C is configured to curl the wire W that is fed by the wire feeding unit 30. The induction guide 51C is configured to guide the wire W curled by the curl guide 50C to the binding unit 7A. Thereby, the wire W is wound around the reinforcing bars S.

In the binding machine 1C, in a state where the wire W is wound around the reinforcing bars S along the curl guide 50C and the induction guide 51C, the wire W is engaged by the wire engaging body 70, and then the wire W is fed in the reverse direction in a state where the guide member 53 protrudes to the guide position of the wire W.

Thereby, of the wire W wound around the reinforcing bars S and engaged by the wire engaging body 70, the wire of a portion that is close to the wire feeding unit 3A and can move in the circumferential direction of the loop Ru along the feeding path of the wire W, i.e., the wire W of a portion along the curl guide 50C is restricted from moving toward the reinforcing bars S by the guide member 53. In this state, the wire of a portion close to the tip end-side of the wire W, which is engaged by the wire engaging body 70 and thus has not moved in the circumferential direction of the loop Ru along the feeding path of the wire W, i.e., the wire W of a portion along the induction guide 51C positioned on the opposite side to the curl guide 50C with respect to the reinforcing bars S is first moved toward the reinforcing bars S and is brought into contact with the reinforcing bars S. Then, the wire W is further fed in the reverse direction in a state where the guide member 53 is moved from the guide position to the retreat position of the wire W. Thereby, the wire W of a portion along the curl guide 50C is moved toward the reinforcing bars S to cause the wire to contact the reinforcing bars S, so that the wire W can be securely wound on the reinforcing bars S.

What is claimed is:

1. A binding machine comprising:

a wire feeder configured to feed a wire;

a curl guide arranged along a loop feed path and configured to curl the wire that is fed in a forward direction by the wire feeder so that the wire is curled and feed along the loop feed path; and a binding unit configured to twist the wire fed in a reverse direction by the wire feeder and wound on an object, wherein the binding unit includes a wire engaging body, the wire engaging body including a clamp that engages a tip end-side of the wire fed in the forward direction by the wire feeder, curled by the curl guide and wound around the object, wherein the wire is feed in a loop around the object, with the loop having a first side adjacent the curl guide and a second side on an opposite side of the loop than the first side, and wherein with the loop around the object, the object is between the first side of the loop and the second side of the loop, and wherein the binding machine includes a pulling unit for pulling wire on the second side of the loop toward the object earlier than wire on the first side of the loop, and wherein the pulling unit pulls wire on the second side of the loop when the wire is engaged by the clamp and fed in the reverse direction by the wire feeder.

2. The binding machine according to claim 1, further comprising an induction guide configured to guide the wire curled by the curl guide to the binding unit, wherein the induction guide is arranged along the loop feed path on an opposite side of the loop feed path than the curl guide, with the object between the induction guide and the curl guide, and wherein the pulling unit pulls the wire on the second side of the loop along the induction guide earlier than the wire on the first side of the loop along the curl guide.

3. The binding machine according to claim 1, wherein the pulling unit is configured to keep the wire on the first side of the loop apart from the object while pulling the wire on the second side of the loop toward the object.

4. The binding machine according to claim 1, wherein the pulling unit includes:

a guide member provided adjacent the curl guide, with the loop feed path extending between the guide member and the curl guide, the guide member movable between a guide position and a retreat position, the guide position being on a radially inner side of the loop feed path of the wire and the retreat position being offset from the loop feed path of the wire and offset from the guide position in a direction away from the object, and wherein the guide member is moved from the guide position to the retreat position after starting an operation of feeding the wire in the reverse direction by the wire feeder.

5. The binding machine according to claim 4, wherein the pulling unit further includes:

a support member having an end portion, the support member being rotatable such that the guide member moves between the guide position and the retreat position by rotation motion of the support member;

a spring urging the support member in a direction to move the guide member toward the guide position or toward the retreat position; and an actuator that regulates rotation of the support member in the direction in which the spring urges the support member.

6. The binding machine according to claim 4, further including a controller configured to control movement of the guide member from the guide position to the retreat position.

7. The binding machine according to claim 4, further including a controller configured to control movement of the guide member from the guide position to the retreat position based on at least one of elapse of time, a feeding amount of the wire, and a load applied to the wire, after starting an operation of feeding the wire in the reverse direction by the wire feeder.

8. The binding machine according to claim 4, wherein the wire is fed in the forward direction by the wire feeder before the guide member is moved from the guide position to the retreat position by the guide member moving mechanism after starting an operation of feeding the wire in the reverse direction by the wire feeder.

9. The binding machine according to claim 4, wherein the pulling unit further includes a spring urging the guide member in a direction in which the guide member moves to the guide position, wherein the guide member has a surface facing outward of the loop feed path of the wire, the surface of the guide member being inwardly inclined from one side near the retreat position to another side near the guide position, and wherein, when the wire is fed in the reverse direction, the guide member is pushed toward the retreat position by wire in contact with the inclined surface of the guide member.

10. The binding machine according to claim 1, wherein the pulling unit includes a guide member provided for the curl guide, wherein the guide member is fixed at a position on a radially inner side of the loop feed path of the wire, wherein the curl guide has a surface facing the guide member, with a gap between the surface of the curl guide and the guide member, and with the loop feed path extending through the gap, and wherein the guide member has a surface facing outward of the loop feed path of the wire, the surface of the guide member being inwardly inclined toward the gap.

* * * * *